US012521779B2

(12) United States Patent
Yan et al.

(10) Patent No.: US 12,521,779 B2
(45) Date of Patent: Jan. 13, 2026

(54) METHOD FOR MANUFACTURING ROLLFORMING FRAME, AND ROLLFORMING FRAME

(71) Applicant: SUZHOU EFFICIENT PROFILE INTELLIGENT MANUFACTURING CO., LTD, Suzhou (CN)

(72) Inventors: Peijie Yan, Suzhou (CN); Hui Zhang, Suzhou (CN)

(73) Assignee: SUZHOU EFFICIENT PROFILE INTELLIGENT MANUFACTURING CO., LTD, Suzhou (CN)

( * ) Notice: Subject to any disclaimer, the term of this patent is extended or adjusted under 35 U.S.C. 154(b) by 0 days.

(21) Appl. No.: 19/002,812

(22) Filed: Dec. 27, 2024

(65) Prior Publication Data

US 2025/0121420 A1 Apr. 17, 2025

Related U.S. Application Data

(63) Continuation of application No. PCT/CN2023/100557, filed on Jun. 16, 2023.

(30) Foreign Application Priority Data

May 22, 2023 (CN) ..... 202310579604.5

(51) Int. Cl.
*B21D 5/06* (2006.01)
*B21D 5/08* (2006.01)

(52) U.S. Cl.
CPC ..... *B21D 5/06* (2013.01); *B21D 5/08* (2013.01); *B21D 5/083* (2013.01); *B21D 5/086* (2013.01)

(58) Field of Classification Search
CPC . B21D 5/06; B21D 5/08; B21D 5/083; B21D 5/086
See application file for complete search history.

(56) References Cited

U.S. PATENT DOCUMENTS 3,638,465 A * 2/1972 Lickliter ..... B21D 47/01 72/181
4,238,550 A * 12/1980 Burgess ..... B21D 5/086 428/595

(Continued)

FOREIGN PATENT DOCUMENTS

CN 203061615 U 7/2013
CN 109318692 A 2/2019

(Continued)

*Primary Examiner* — Christopher L Templeton
*Assistant Examiner* — Matthew Stephens
(74) *Attorney, Agent, or Firm* — Bayramoglu Law Offices LLC

(57) ABSTRACT

A method for manufacturing a rollforming frame includes: forming a first vertical wall and a first horizontal wall connected to each other at two opposite ends of a to-be-machined plate; rolling and bending the first horizontal wall to form a stepped bent structure; rolling and bending the first horizontal wall to form a second vertical wall, a second horizontal wall, and a third horizontal wall; rolling and bending the second horizontal wall to form a third vertical wall and a fourth horizontal wall; rolling and bending the third horizontal wall to form a fourth vertical wall and a fifth horizontal wall; rolling and bending one end of the fifth horizontal wall away from the fourth vertical wall to form a connecting edge and a sixth horizontal wall; rolling and bending the sixth horizontal wall to form a fifth vertical wall and a seventh horizontal wall.

13 Claims, 29 Drawing Sheets

(56) References Cited

U.S. PATENT DOCUMENTS

| | | | | |
|---|---|---|---|---|
| 2012/0074720 | A1* | 3/2012 | Johnson | B21D 5/14 72/176 |
| 2019/0031044 | A1 | 1/2019 | Paulsen | |
| 2020/0164820 | A1* | 5/2020 | Baas | B23K 26/34 |

FOREIGN PATENT DOCUMENTS

| | | | | |
|---|---|---|---|---|
| CN | 111916603 | A | 11/2020 | |
| CN | 112078525 | A | 12/2020 | |
| CN | 215070282 | U | 12/2021 | |
| CN | 114192641 | A | 3/2022 | |
| CN | 216288746 | U | 4/2022 | |
| CN | 115228987 | A | 10/2022 | |
| CN | 115507286 | A | 12/2022 | |
| CN | 115890167 | A | 4/2023 | |
| EP | 1029610 | A1 * | 8/2000 | B21D 5/08 |
| KR | 20210144378 | A | 11/2021 | |
| KR | 20220068646 | A | 5/2022 | |
| KR | 20230055176 | A | 4/2023 | |

* cited by examiner

Angle 5 and angle 6 for 16th to 23rd passes of forming

Angle 7 and angle 8 for 24th to 34th passes of forming

Angle 10 for 40th to 45th passes of forming

Third and fourth weld seams in a 46th pass of welding

47th and 48th passes of shaping

METHOD FOR MANUFACTURING ROLLFORMING FRAME, AND ROLLFORMING FRAME

CROSS REFERENCE TO THE RELATED APPLICATIONS

This application is a continuation application of International Application No. PCT/CN2023/100557, filed on Jun. 16, 2023, which is based upon and claims priority to Chinese Patent Application No. 202310579604.5, filed on May 22, 2023, the entire contents of which are incorporated herein by reference.

TECHNICAL FIELD

The present invention relates to the technical field of rollforming profiles, specifically, to a method for manufacturing a rollforming frame, and the rollforming frame.

BACKGROUND

In the current processing method for the main structure of a battery pack frame, joints of left and right longitudinal beams and front and rear transverse beams (four parts) are peripherally butt-welded to form a prefabricated frame, then the prefabricated frame is welded with a bottom steel plate, and finally a battery pack tray is formed. The above processing method has the following defects: a, there are many types of materials, including five types of materials; b, there is a long machining process including frame material rolling, welding, frame butt-welding, steel plate and frame butt-welding, and laser hole-cutting, resulting in low production efficiency; c, there is high difficulty in quality control and welding due to a large amount of deformation after welding and low dimensional accuracy, and a subsequent laser cutting process is needed to ensure the mounting accuracy of riveting holes; and d, there are high costs for equipment investment, machining, labor, etc.

SUMMARY

In view of the defects in the prior art, the present invention aims to provide a method for manufacturing a rollforming frame, and the rollforming frame.

A method for manufacturing a rollforming frame provided according to an embodiment of the present invention includes the following steps:

step 1: separately rolling and bending two opposite ends of a to-be-machined plate to separately form a first vertical wall and a first horizontal wall connected to each other at the two opposite ends of the to-be-machined plate, where a bottom plate is formed between the two first vertical walls;

step 2: rolling and bending one end of the first horizontal wall adjacent to the first vertical wall to form a stepped bent structure;

step 3: rolling and bending the first horizontal wall to form a second vertical wall, a second horizontal wall, and a third horizontal wall that are connected;

step 4: rolling and bending the second horizontal wall to form a third vertical wall and a fourth horizontal wall connected to each other; and rolling and bending the third horizontal wall to form a fourth vertical wall and a fifth horizontal wall connected to each other, where the fourth vertical wall abuts against the first vertical wall;

step 5: performing laser welding on a joint of the fourth vertical wall and the first vertical wall, where the second vertical wall, the third vertical wall, the fourth horizontal wall, and the first vertical wall form a first cavity and a second cavity;

step 6: rolling and bending one end of the fifth horizontal wall away from the fourth vertical wall to form a connecting edge and a sixth horizontal wall connected to each other;

step 7: rolling and bending the sixth horizontal wall to form a fifth vertical wall and a seventh horizontal wall connected to each other, where the connecting edge abuts against the second vertical wall; and step 8: performing laser welding on a joint of the connecting edge and the second vertical wall, where the fourth vertical wall, the fifth vertical wall, the seventh horizontal wall, and the second vertical wall form a third cavity and a fourth cavity.

Preferably, in the step 1, a first bend structure is formed between the first vertical wall and the bottom plate, and a second bend structure is formed between the first horizontal wall and the first vertical wall;

in the step 2, a third bend structure and a fourth bend structure are formed in the stepped bent structure;

in the step 3, two ends of the second horizontal wall are connected to the stepped bent structure and the second vertical wall respectively, a fifth bend structure is formed between the second horizontal wall and the second vertical wall, and a sixth bend structure is formed between the second vertical wall and the third horizontal wall;

in the step 4, a seventh bend structure is formed between the third vertical wall and the fourth horizontal wall, and two ends of the fourth horizontal wall are connected to the stepped bent structure and the third vertical wall respectively;

an eighth bend structure is formed between the fourth vertical wall and the fifth horizontal wall, and two ends of the fourth vertical wall are connected to the fifth horizontal wall and the second vertical wall respectively;

in the step 6, a ninth bend structure is formed between the connecting edge and the sixth horizontal wall; and in the step 7, a tenth bend structure is formed between the fifth vertical wall and the seventh horizontal wall, and two ends of the fifth vertical wall are connected to the connecting edge and the seventh horizontal wall respectively.

Preferably, the step 1 specifically includes the following steps:

step 1.1: separately rolling and bending the two opposite ends of the to-be-machined plate to form a first side edge structure and a second side edge structure at the two opposite ends of the to-be-machined plate respectively, where the bottom plate is formed between the first side edge structure and the second side edge structure, a first corner structure is formed between the first side edge structure and the bottom plate, and a first corner structure is formed between the second side edge structure and the bottom plate;

step 1.2: separately rolling and bending the first side edge structure and the second side edge structure to form the first vertical wall and the first horizontal wall, where a second corner structure is formed between the first vertical wall and the first horizontal wall; and step 1.3: rolling and bending the first vertical wall and the first horizontal wall for multiple times, gradually reducing an angle of the first corner structure to form the first bend structure, and gradually reducing an angle of the second corner structure to form the second bend structure.

Further, in the step 1.1, the angle of the first corner structure is 177°;

in the step 1.2, the angle of the first corner structure is 170°, and the angle of the second corner structure is 172°; and the step 1.3 specifically includes the following steps:

step 1.3.1: rolling and bending the first vertical wall and the first horizontal wall, such that the angle of the first corner structure is 160°, and the angle of the second corner structure is 162°;

step 1.3.2: rolling and bending the first vertical wall and the first horizontal wall, such that the angle of the first corner structure is 145°, and the angle of the second corner structure is 148°;

step 1.3.3: rolling and bending the first vertical wall and the first horizontal wall, such that the angle of the first corner structure is 130°, and the angle of the second corner structure is 132°;

step 1.3.4: rolling and bending the first vertical wall and the first horizontal wall, such that the angle of the first corner structure is 115°, and the angle of the second corner structure is 118°;

step 1.3.5: rolling and bending the first vertical wall and the first horizontal wall, such that the angle of the first corner structure is 100°, and the angle of the second corner structure is 103°;

step 1.3.6: rolling and bending the first vertical wall and the first horizontal wall, such that the angle of the first corner structure is 90°, the first bend structure is formed, and the angle of the second corner structure is 93°; and step 1.3.7: rolling and bending the first horizontal wall, such that the angle of the second corner structure is 90°, and the second bend structure is formed.

Further, the step 2 specifically includes the following steps:

step 2.1: rolling and bending one end of the first horizontal wall adjacent to the first vertical wall to form a stepped planar structure and a third side edge structure, where a third corner structure is formed between the stepped planar structure and the third side edge structure;

step 2.2: rolling and bending the third side edge structure to form a stepped inclined surface structure and a fourth side edge structure, where the third corner structure is formed between the stepped planar structure and the stepped inclined surface structure, and a fourth corner structure is formed between the stepped inclined surface structure and the fourth side edge structure; and step 2.3: rolling and bending the fourth side edge structure and the stepped inclined surface structure for multiple times, gradually increasing an angle of the third corner structure to form the third bend structure, and gradually increasing an angle of the fourth corner structure to form the fourth bend structure.

Further, in the step 2.1, the angle of the third corner structure is 3°;

in the step 2.2, the angle of the third corner structure is 15° and the angle of the fourth corner structure is 13°; and the step 2.3 specifically includes the following steps:

step 2.3.1: rolling and bending the fourth side edge structure and the stepped inclined surface structure, such that the angle of the third corner structure is 30° and the angle of the fourth corner structure is 28°;

step 2.3.2: rolling and bending the fourth side edge structure and the stepped inclined surface structure, such that the angle of the third corner structure is 45° and the angle of the fourth corner structure is 42°;

step 2.3.3: rolling and bending the fourth side edge structure and the stepped inclined surface structure, such that the angle of the third corner structure is 54°, the third bend structure is formed, and the angle of the fourth corner structure is 52°; and step 2.3.4: rolling and bending the fourth side edge structure, such that the angle of the fourth corner structure is 54° and the fourth bend structure is formed.

Further, the step 3 specifically includes the following steps:

step 3.1: rolling and bending the first horizontal wall to form the second horizontal wall and a fifth side edge structure, where a fifth corner structure is formed between the second horizontal wall and the fifth side edge structure;

step 3.2: rolling and bending the fifth side edge structure to form the second vertical wall and the third horizontal wall, where the fifth corner structure is formed between the second horizontal wall and the second vertical wall, and a sixth corner structure is formed between the second vertical wall and the third horizontal wall; and step 3.3: rolling and bending the second vertical wall and the third horizontal wall for multiple times, gradually reducing an angle of the fifth corner structure to form the fifth bend structure, and gradually reducing an angle of the sixth corner structure to form the sixth bend structure.

Further, in the step 3.1, the angle of the fifth corner structure is 176°;

in the step 3.2, the angle of the fifth corner structure is 165° and the angle of the sixth corner structure is 170°; and the step 3.3 specifically includes the following steps:

step 3.3.1: rolling and bending the second vertical wall and the third horizontal wall, such that the angle of the fifth corner structure is 150°, and the angle of the sixth corner structure is 155°;

step 3.3.2: rolling and bending the second vertical wall and the third horizontal wall, such that the angle of the fifth corner structure is 135°, and the angle of the sixth corner structure is 140°;

step 3.3.3: rolling and bending the second vertical wall and the third horizontal wall, such that the angle of the fifth corner structure is 120°, and the angle of the sixth corner structure is 125°;

step 3.3.4: rolling and bending the second vertical wall and the third horizontal wall, such that the angle of the fifth corner structure is 105°, and the angle of the sixth corner structure is 110°;

step 3.3.5: rolling and bending the second vertical wall and the third horizontal wall, such that the angle of the fifth corner structure is 90°, the fifth bend structure is formed, and the angle of the sixth corner structure is 95°; and step 3.3.6: rolling and bending the third horizontal wall, such that the angle of the sixth corner structure is 90° and the sixth bend structure is formed.

Further, the step 4 specifically includes the following steps:

step 4.1: rolling and bending the second horizontal wall to form the third vertical wall and the fourth horizontal wall, where a seventh corner structure is formed between the third vertical wall and the fourth horizontal wall;

step 4.2: rolling and bending the third vertical wall, and reducing an angle of the seventh corner structure for the first time;

step 4.3: rolling the third horizontal wall to form the fourth vertical wall and the fifth horizontal wall, where an eighth corner structure is formed between the fourth vertical wall and the fifth horizontal wall; and rolling and bending the third vertical wall, and reducing the angle of the seventh corner structure for the second time; and step 4.4: rolling and bending the fifth horizontal wall and the third vertical wall for multiple times, gradually reducing the angle of the seventh corner structure to form the seventh bend structure, and gradually reducing an angle of the eighth corner structure to form the eighth bend structure.

Further, in the step 4.1, the angle of the seventh corner structure when formed is 175°;

in the step 4.2, the angle of the seventh corner structure is 170°;

in the step 4.3, the angle of the seventh corner structure is 160°, and the angle of the eighth corner structure is 170°; and the step 4.4 specifically includes the following steps:

step 4.4.1: rolling and bending the fifth horizontal wall and the third vertical wall, such that the angle of the seventh corner structure is 150°, and the angle of the eighth corner structure is 160°;

step 4.4.2: rolling and bending the fifth horizontal wall and the third vertical wall, such that the angle of the seventh corner structure is 140°, and the angle of the eighth corner structure is 150°;

step 4.4.3: rolling and bending the fifth horizontal wall and the third vertical wall, such that the angle of the seventh corner structure is 130°, and the angle of the eighth corner structure is 140°;

step 4.4.4: rolling and bending the fifth horizontal wall and the third vertical wall, such that the angle of the seventh corner structure is 120°, and the angle of the eighth corner structure is 130°;

step 4.4.5: rolling and bending the fifth horizontal wall and the third vertical wall, such that the angle of the seventh corner structure is 110°, and the angle of the eighth corner structure is 120°;

step 4.4.6: rolling and bending the fifth horizontal wall and the third vertical wall, such that the angle of the seventh corner structure is 100°, and the angle of the eighth corner structure is 110°;

step 4.4.7: rolling and bending the fifth horizontal wall and the third vertical wall, such that the angle of the seventh corner structure is 90°, the seventh bend structure is formed, and the angle of the eighth corner structure is 100°; and step 4.4.8: rolling and bending the fifth horizontal wall, such that the angle of the eighth corner structure is 90°, and the eighth bend structure is formed.

Further, the step 6 specifically includes the following steps:

step 6.1: rolling and bending one end of the fifth horizontal wall away from the fourth vertical wall to form the connecting edge and the sixth horizontal wall, where a ninth corner structure is formed between the connecting edge and the sixth horizontal wall; and step 6.2: rolling and bending the connecting edge for multiple times, and gradually reducing an angle of the ninth corner structure to form the ninth bend structure.

Further, in the step 6.1, the angle of the ninth corner structure is 180°; and the step 6.2 specifically includes the following steps:

step 6.2.1: rolling and bending the connecting edge, such that the angle of the ninth corner structure is 150°;

step 6.2.2: rolling and bending the connecting edge, such that the angle of the ninth corner structure is 120°; and step 6.2.3: rolling and bending the connecting edge, such that the angle of the ninth corner structure is 90°, and the ninth bend structure is formed.

Further, the step 7 specifically includes the following steps:

step 7.1: rolling and bending the sixth horizontal wall to form the fifth vertical wall and the seventh horizontal wall, where a tenth corner structure is formed between the fifth vertical wall and the seventh horizontal wall; and step 7.2: rolling and bending the fifth vertical wall for multiple times, and gradually reducing an angle of the tenth corner structure to form the tenth bend structure.

Further, in the step 7.1, the angle of the tenth corner structure is 163°; and the step 7.2 specifically includes the following steps:

step 7.2.1: rolling and bending the fifth vertical wall, such that the angle of the tenth corner structure is 145°;

step 7.2.2: rolling and bending the fifth vertical wall, such that the angle of the tenth corner structure is 130°;

step 7.2.3: rolling and bending the fifth vertical wall, such that the angle of the tenth corner structure is 115°;

step 7.2.4: rolling and bending the fifth vertical wall, such that the angle of the tenth corner structure is 100°; and step 7.2.5: rolling and bending the fifth vertical wall, such that the angle of the tenth corner structure is 90°, and the tenth bend structure is formed.

Further, in the step 8, a left longitudinal beam portion and a right longitudinal beam portion are formed at the two opposite ends of the bottom plate; and the method for manufacturing a rollforming frame further includes the following steps:

step 9: cutting the left longitudinal beam portion and the right longitudinal beam portion that are located at four corners of the bottom plate to form a front longitudinal beam plate and a rear longitudinal beam plate at another two opposite ends of the bottom plate;

step 10: separately bending the front longitudinal beam plate and the rear longitudinal beam plate to form a sixth vertical wall and an eighth horizontal wall, where an eleventh bend structure is formed between the sixth vertical wall and the eighth horizontal wall;

step 11: bending the eighth horizontal wall to form a seventh vertical wall and a ninth horizontal wall, where a twelfth bend structure is formed between the seventh vertical wall and the ninth horizontal wall;

step 12: bending the seventh vertical wall to form an eighth vertical wall and a tenth horizontal wall, where a thirteenth bend structure is formed between the eighth vertical wall and the tenth horizontal wall;

step 13: bending the ninth horizontal wall, such that the sixth vertical wall abuts against the bottom plate, a fourteenth bend structure is formed between the ninth horizontal wall and the bottom plate, and a front longitudinal beam portion and a rear longitudinal beam portion are formed at the another two opposite ends of the bottom plate; and step 14: welding a joint of the front longitudinal beam portion and the left longitudinal beam portion, welding a joint of the front longitudinal beam portion and the right longitudinal beam portion, welding a joint of the rear longitudinal beam portion and the left longitudinal beam portion, welding a joint of the rear longitudinal beam portion and the right longitudinal beam portion, and welding a joint of the sixth vertical wall and the bottom plate.

The present invention further provides a rollforming frame manufactured using the above method for manufacturing a rollforming frame.

Further, the rollforming frame includes a bottom plate, a left longitudinal beam portion, and a right longitudinal beam portion, where the left longitudinal beam portion and the right longitudinal beam portion are disposed at two opposite ends of the bottom plate respectively;

each of the left longitudinal beam portion and the right longitudinal beam portion includes the first vertical wall, the fourth horizontal wall, the third vertical wall, the second vertical wall, the fourth vertical wall, the seventh horizontal wall, the fifth vertical wall, and the connecting edge that are sequentially connected;

the fourth horizontal wall, the third vertical wall, and the second vertical wall form a first notch structure, and the second vertical wall, the fourth vertical wall, and the seventh horizontal wall form a second notch structure;

the first vertical wall is connected to an opening end of the first notch structure, and the fourth vertical wall is connected to the first vertical wall; and the fifth vertical wall is connected to an opening end of the second notch structure, and the connecting edge is connected to one end of the second vertical wall adjacent to the third vertical wall.

BRIEF DESCRIPTION OF THE DRAWINGS

Other features, objectives and advantages of the present invention will become more apparent upon reading the detailed description of the non-restrictive embodiments with reference to the following drawings, in which.

In the drawings.

Figure 1:
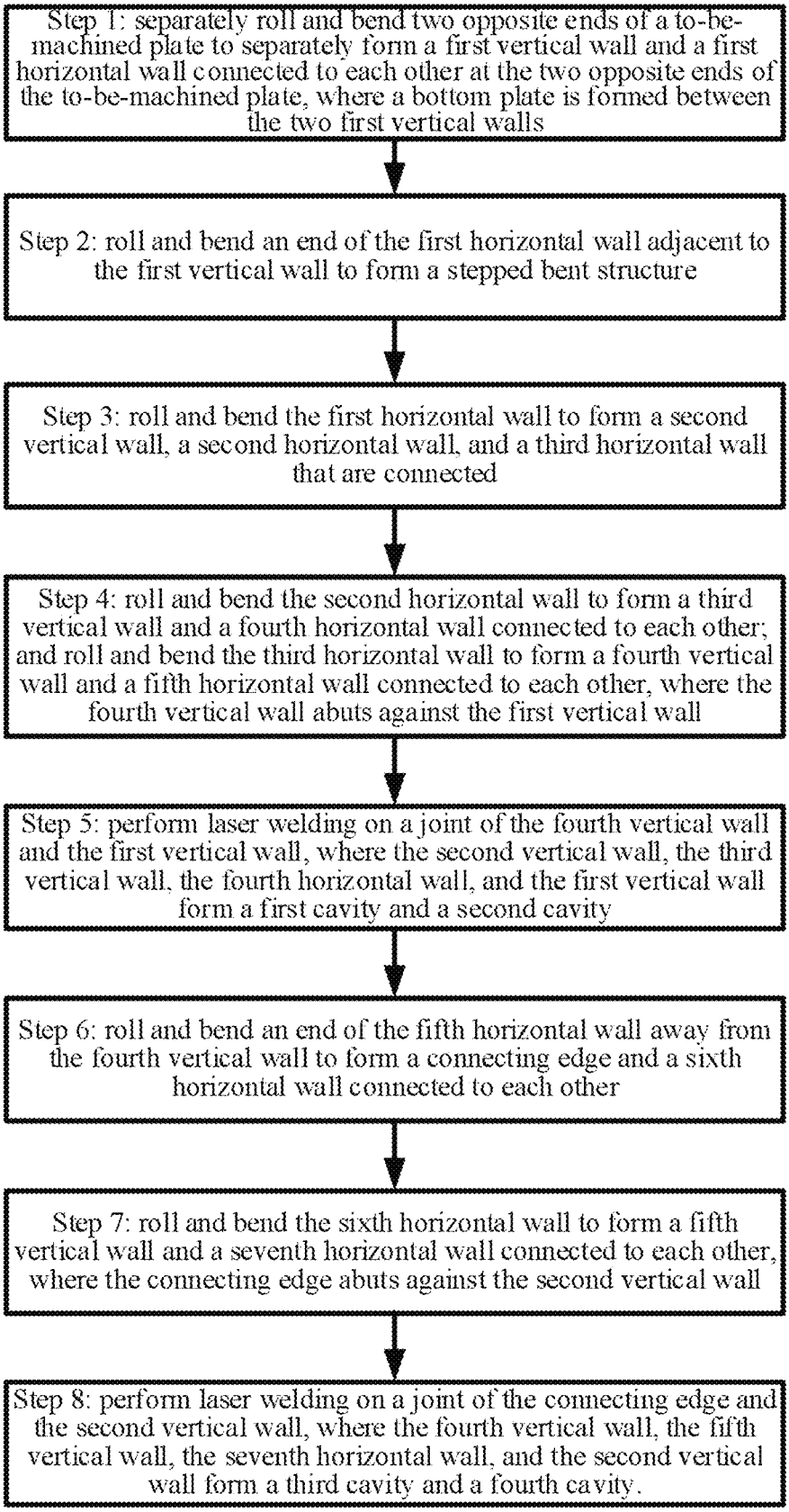
FIG. 1 is a flowchart of steps of a method for manufacturing a rollforming frame in the present invention.
Figure 2:
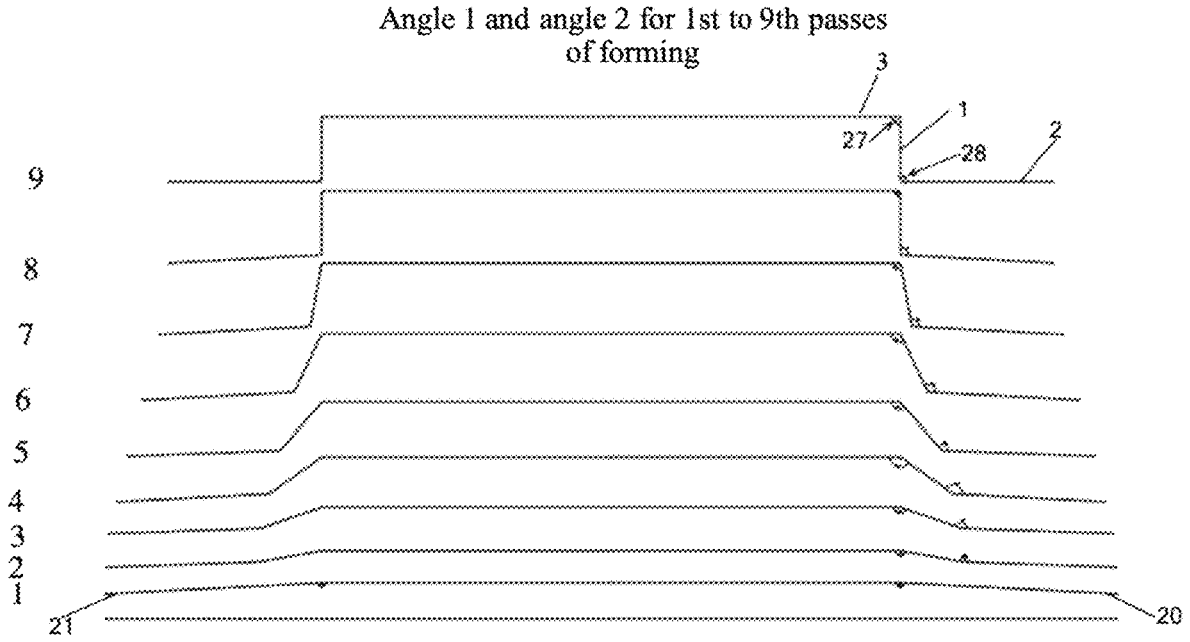
FIG. 2 is a schematic diagram of 1st to 9th passes of forming in a method for manufacturing a rollforming frame in an embodiment.
Figure 3:
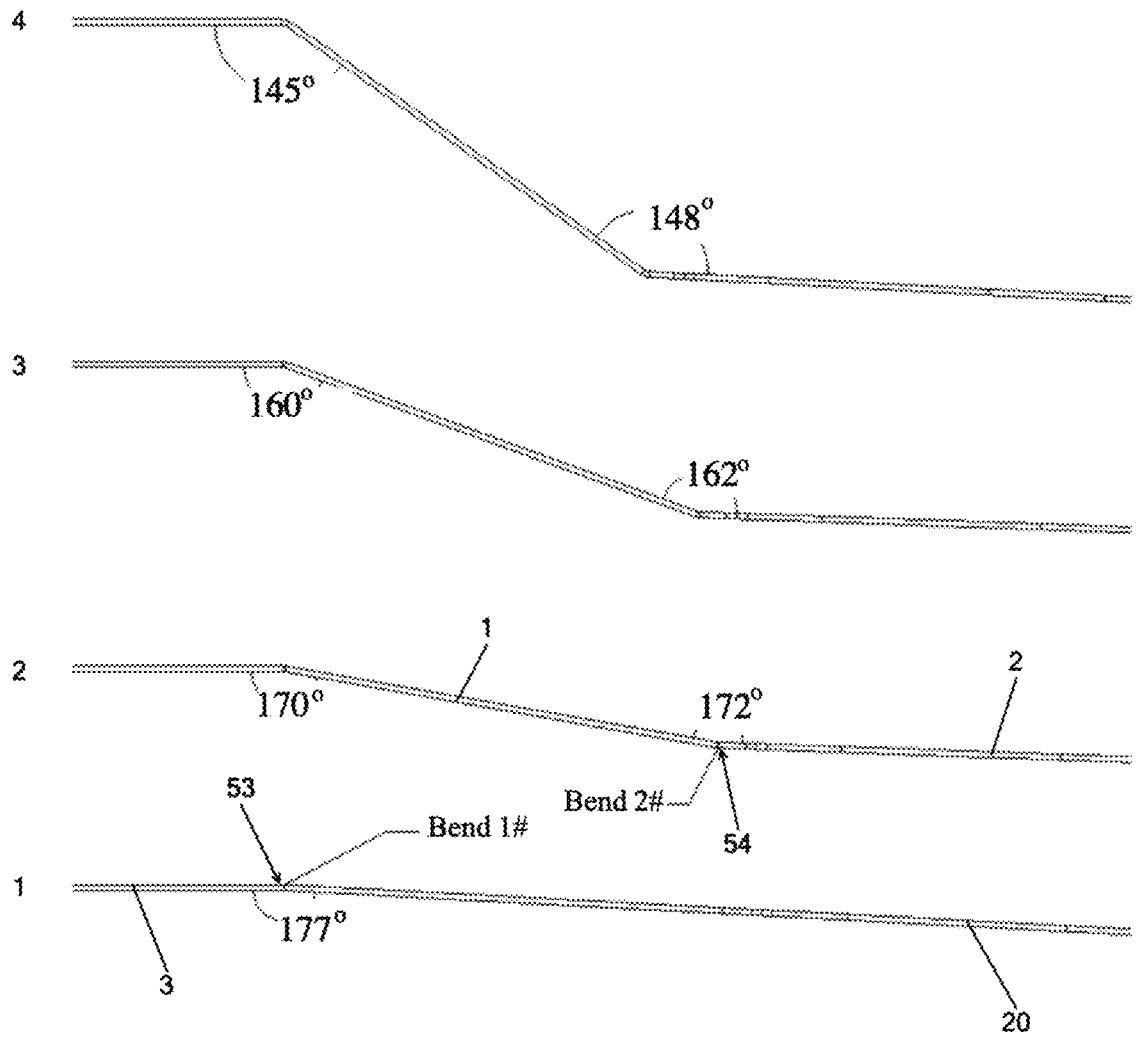
FIGS. 3 to 5 are schematic diagrams of angles for 1st to 9th passes of forming.
Figure 4:
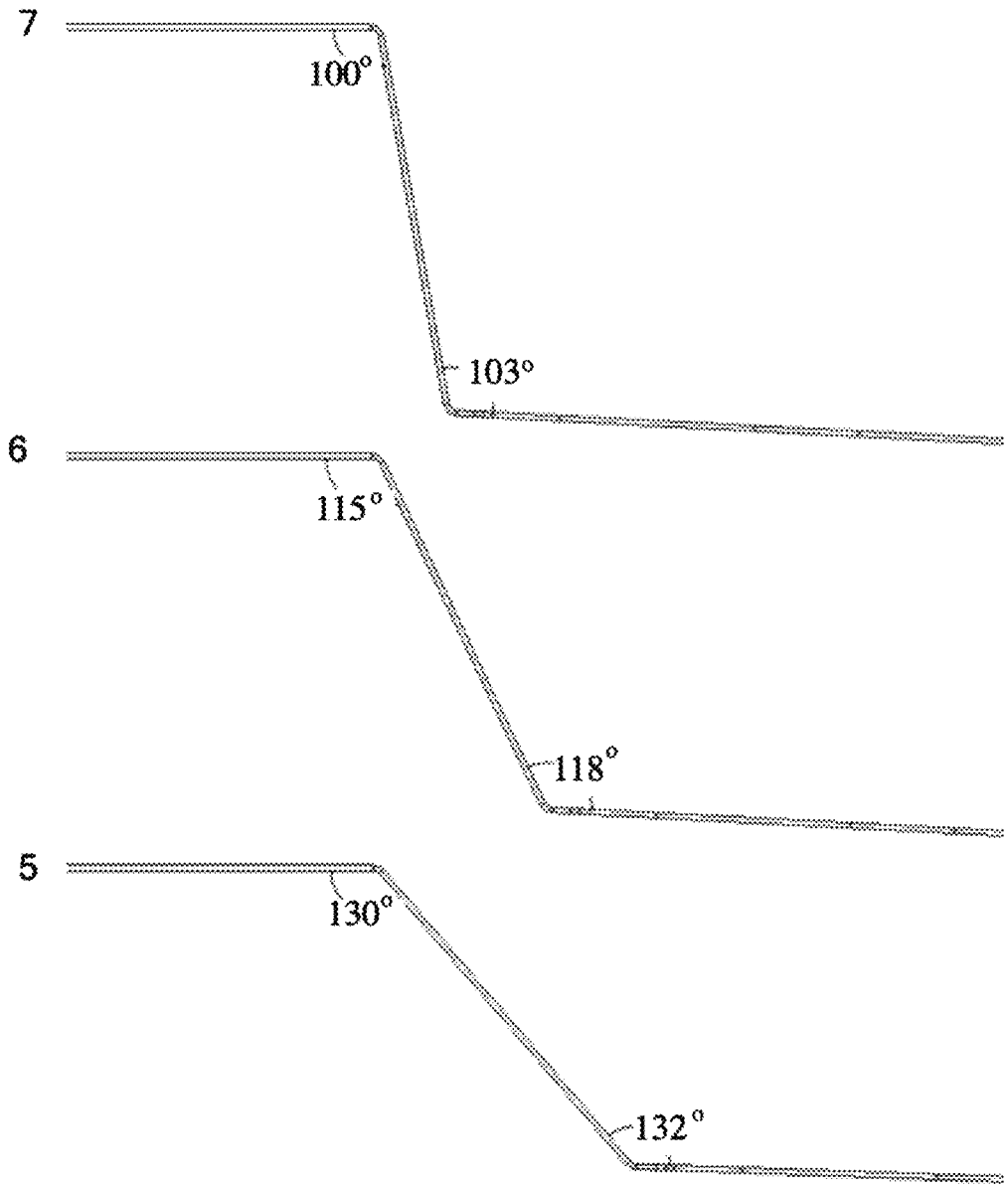
Figure 5:
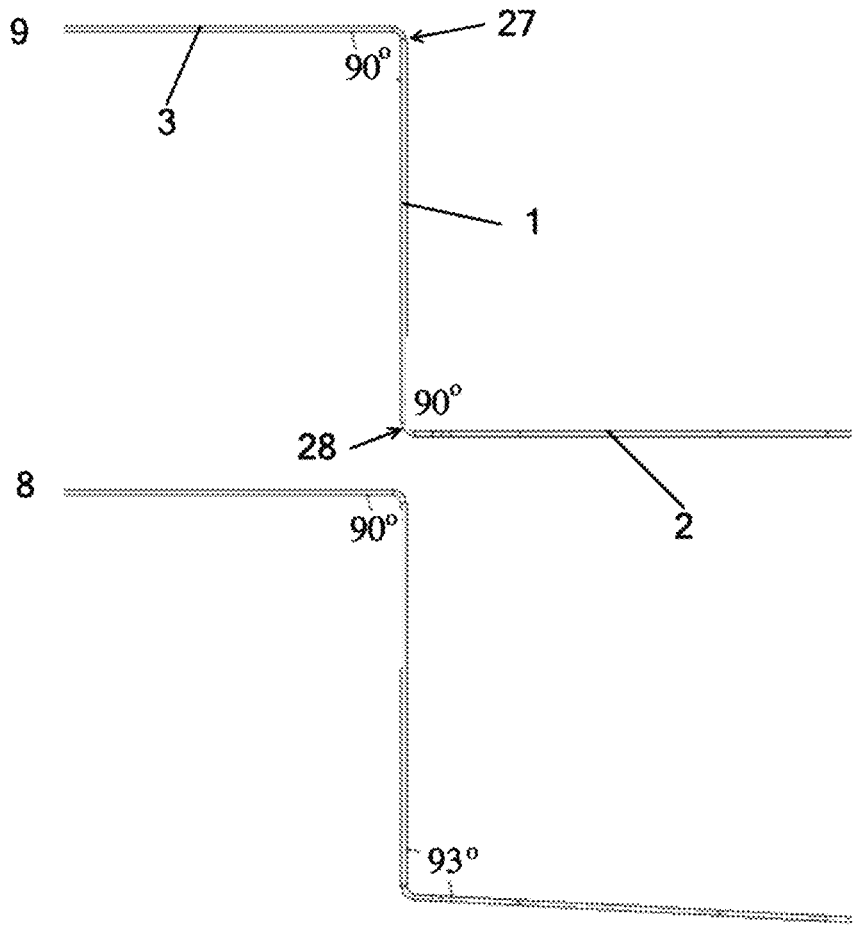
Figure 6:
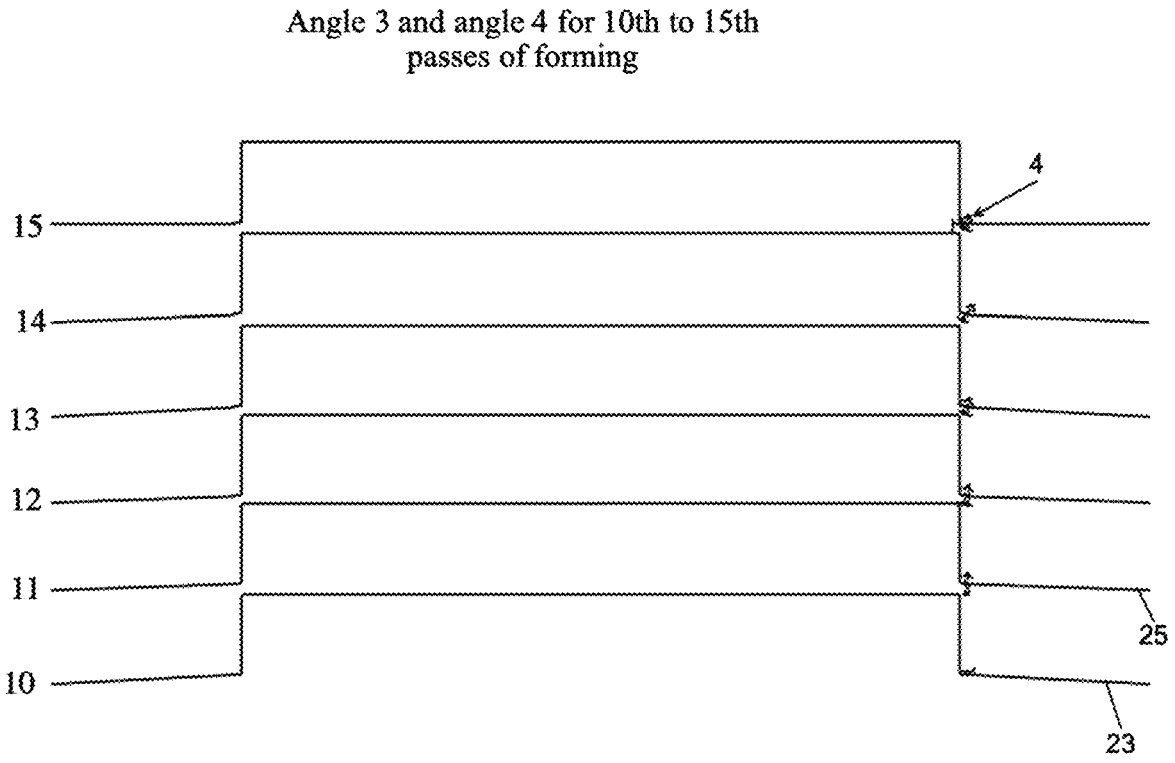
FIG. 6 is a schematic diagram of 10th to 15th passes of forming in a method for manufacturing a rollforming frame in an embodiment.
Figure 7:
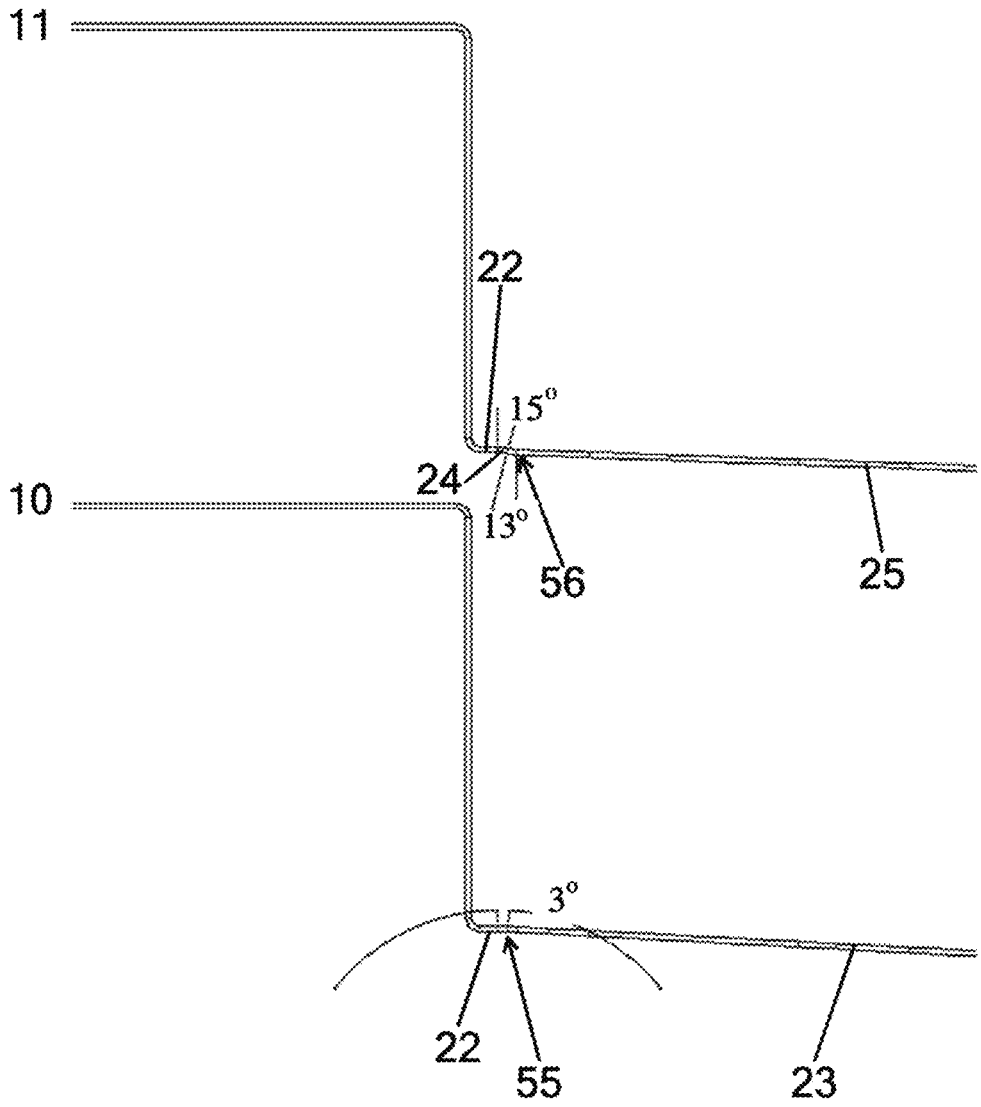
FIGS. 7 to 9 are schematic diagrams of angles for 10th to 15th passes of forming.
Figure 8:
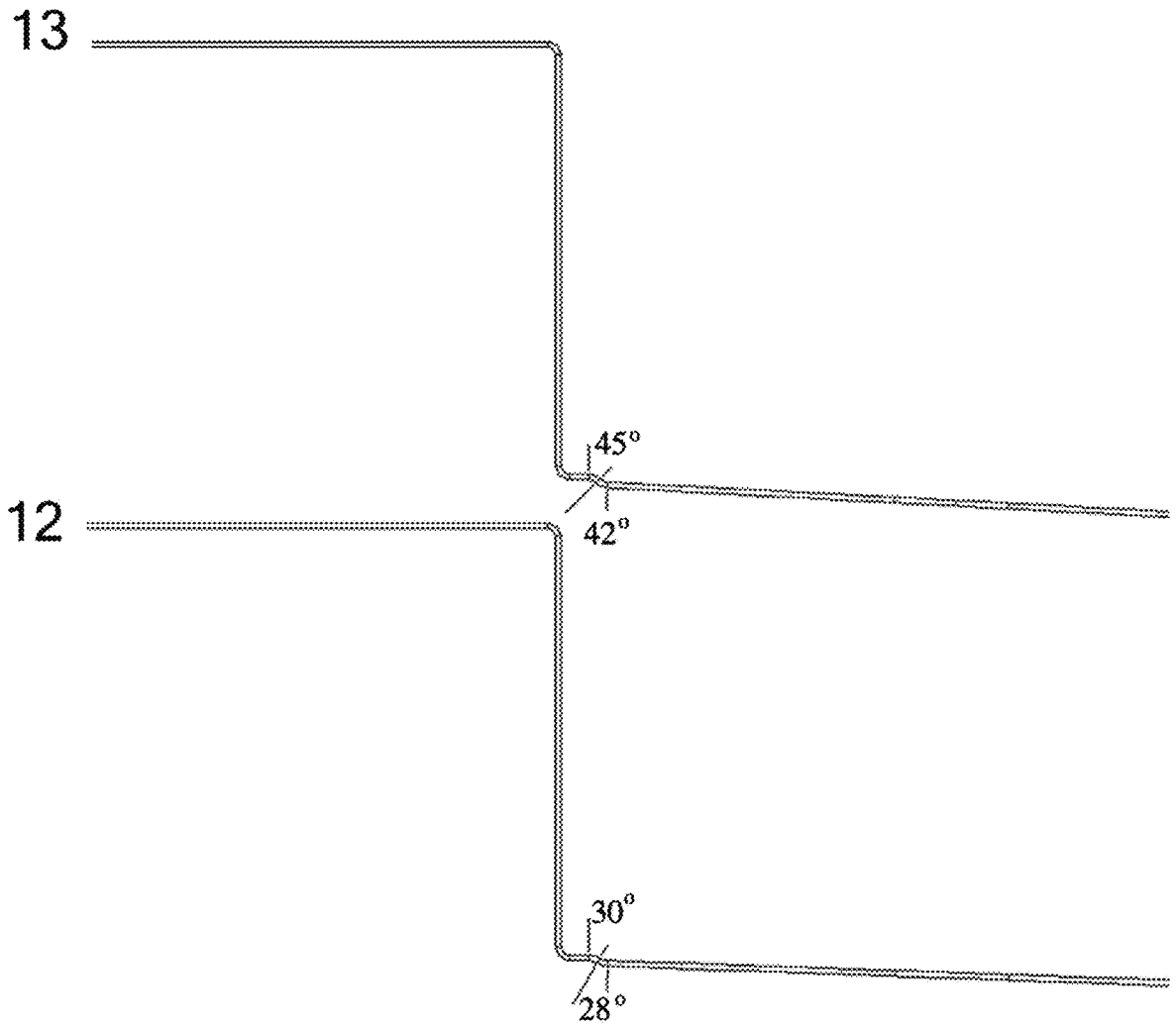
Figure 9:
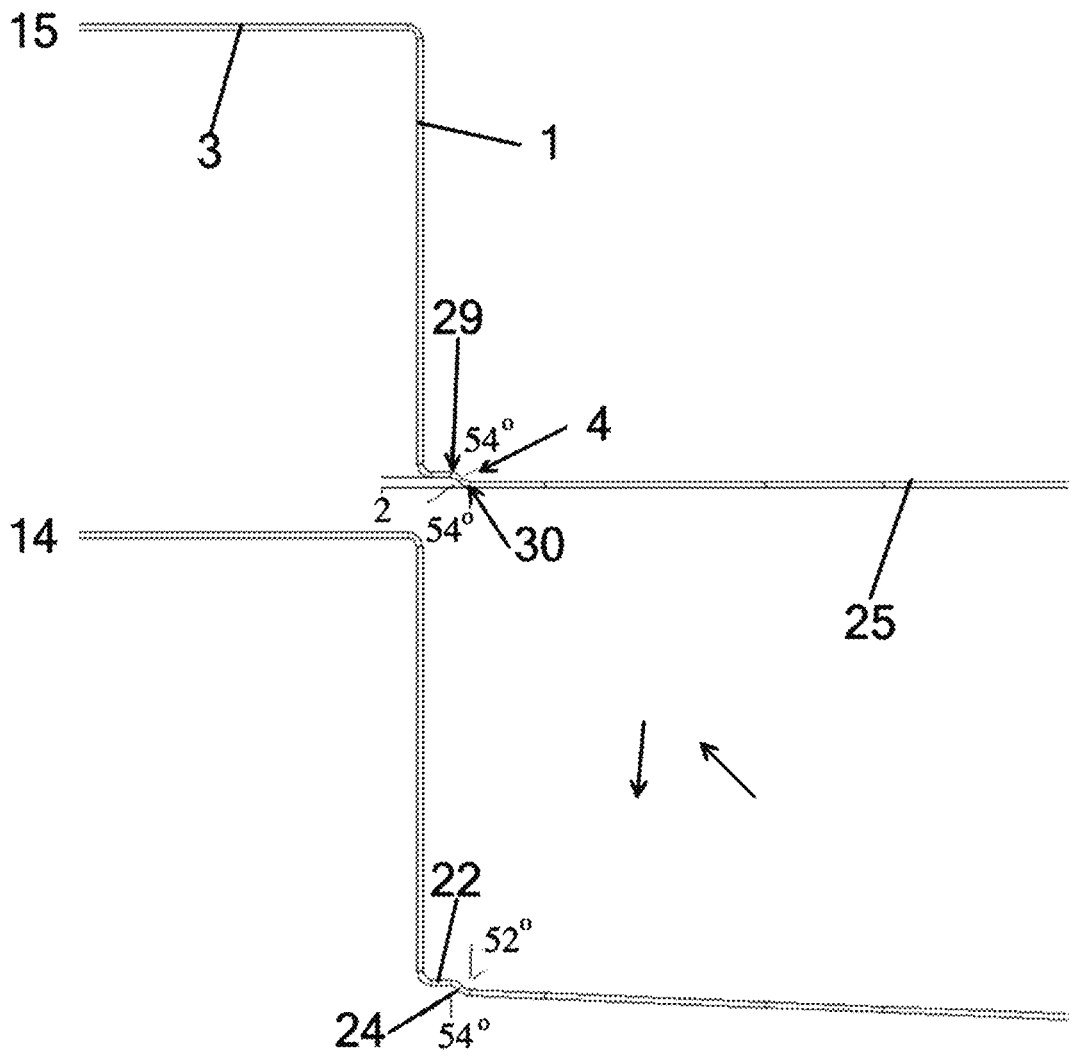
Figure 10:
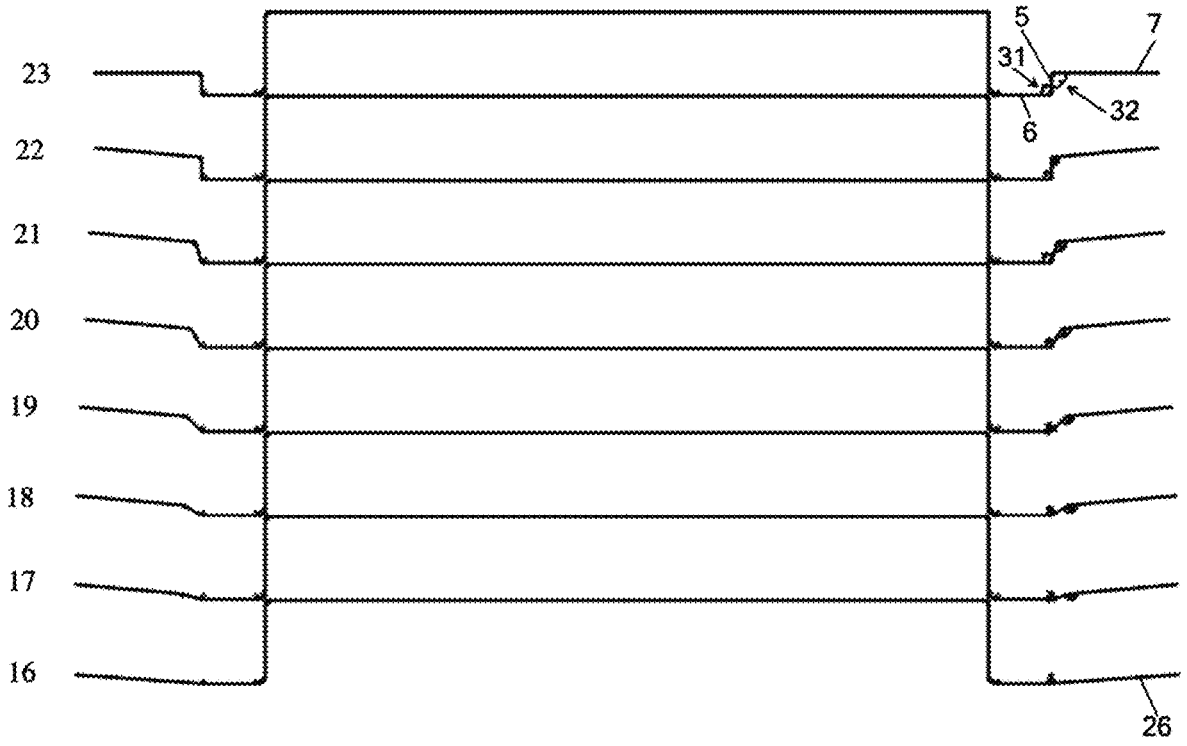
FIG. 10 is a schematic diagram of 16th to 23rd passes of forming in a method for manufacturing a rollforming frame in an embodiment.
Figure 11:
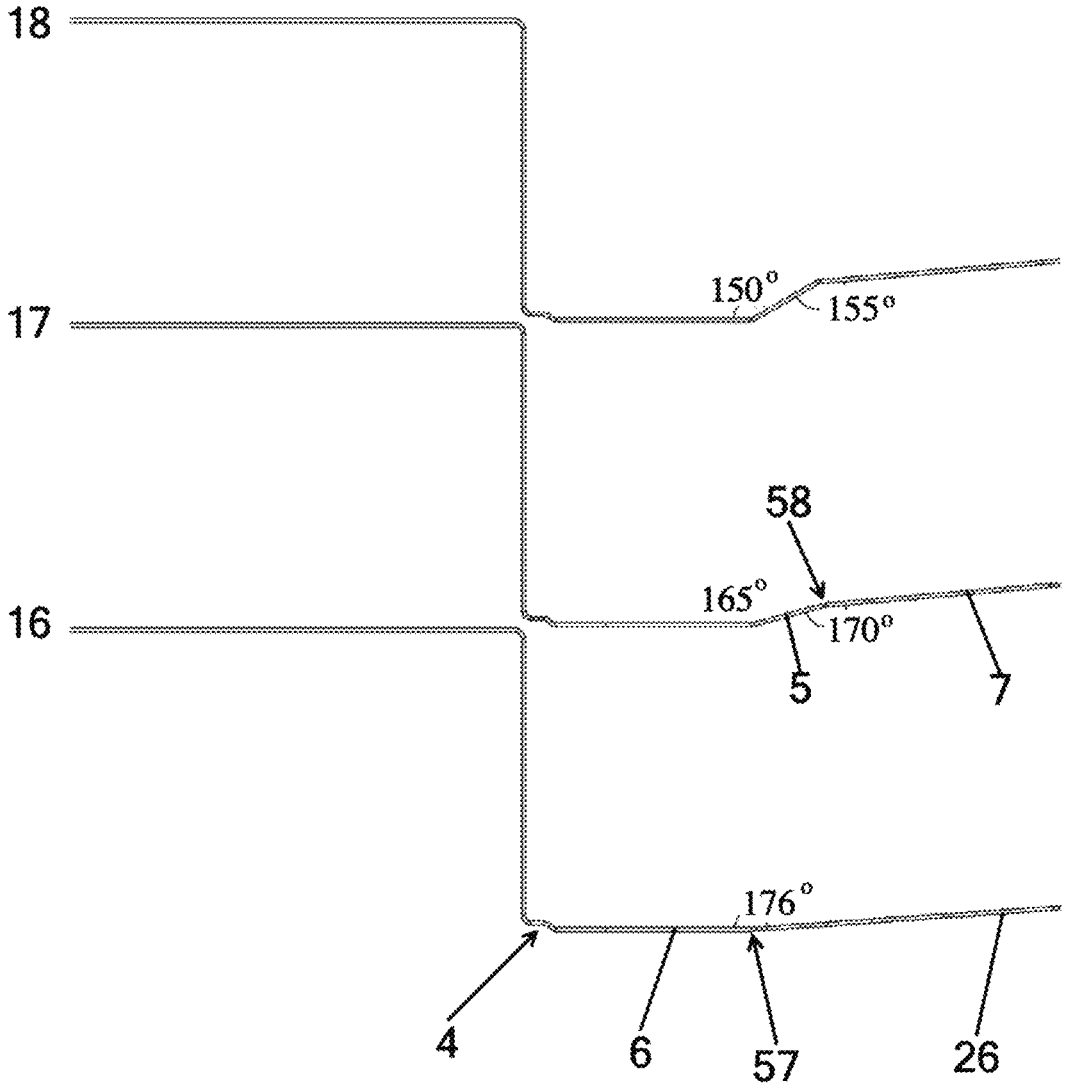
FIGS. 11 to 13 are schematic diagrams of angles for 16th to 23rd passes of forming.
Figure 12:
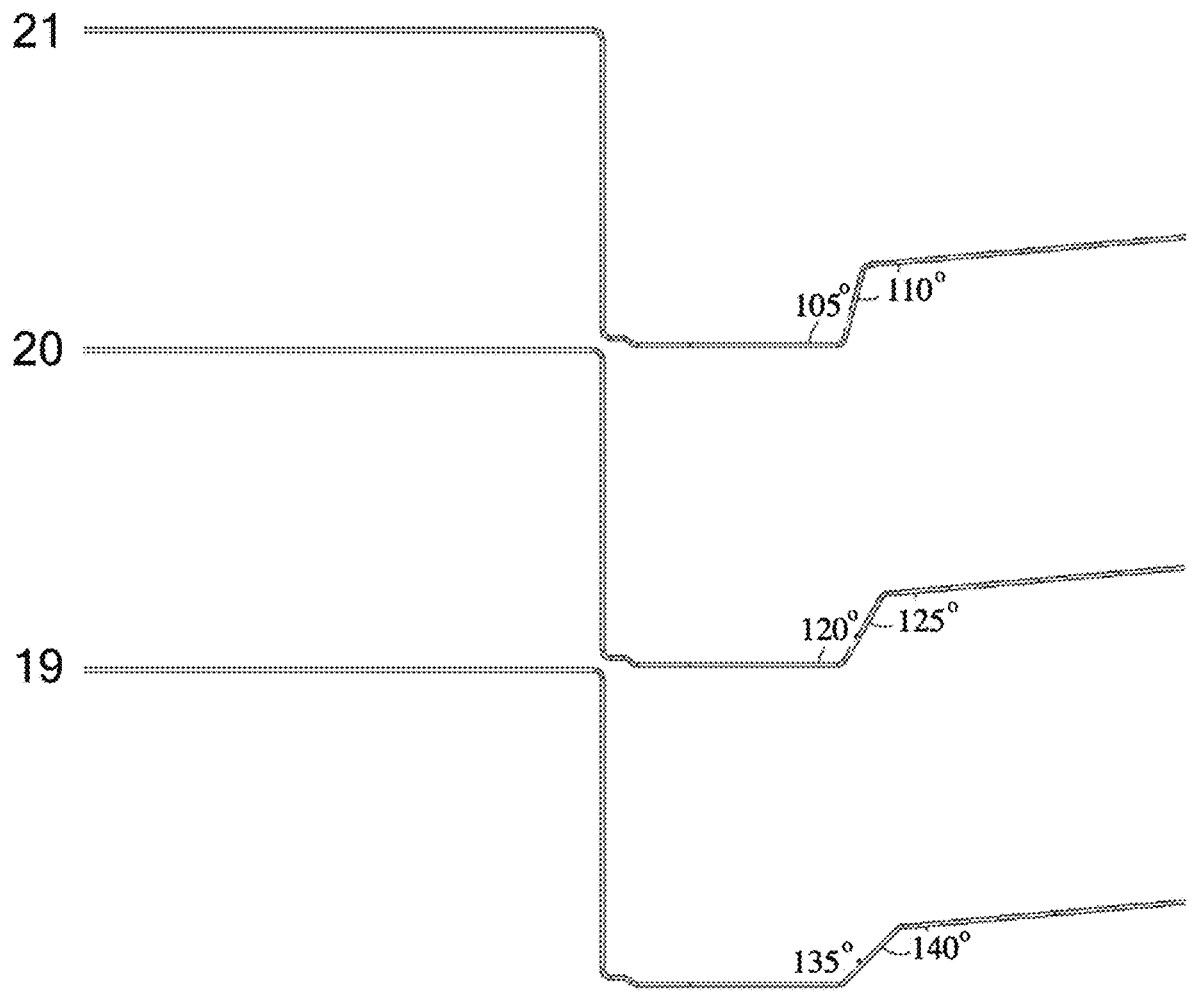
Figure 13:
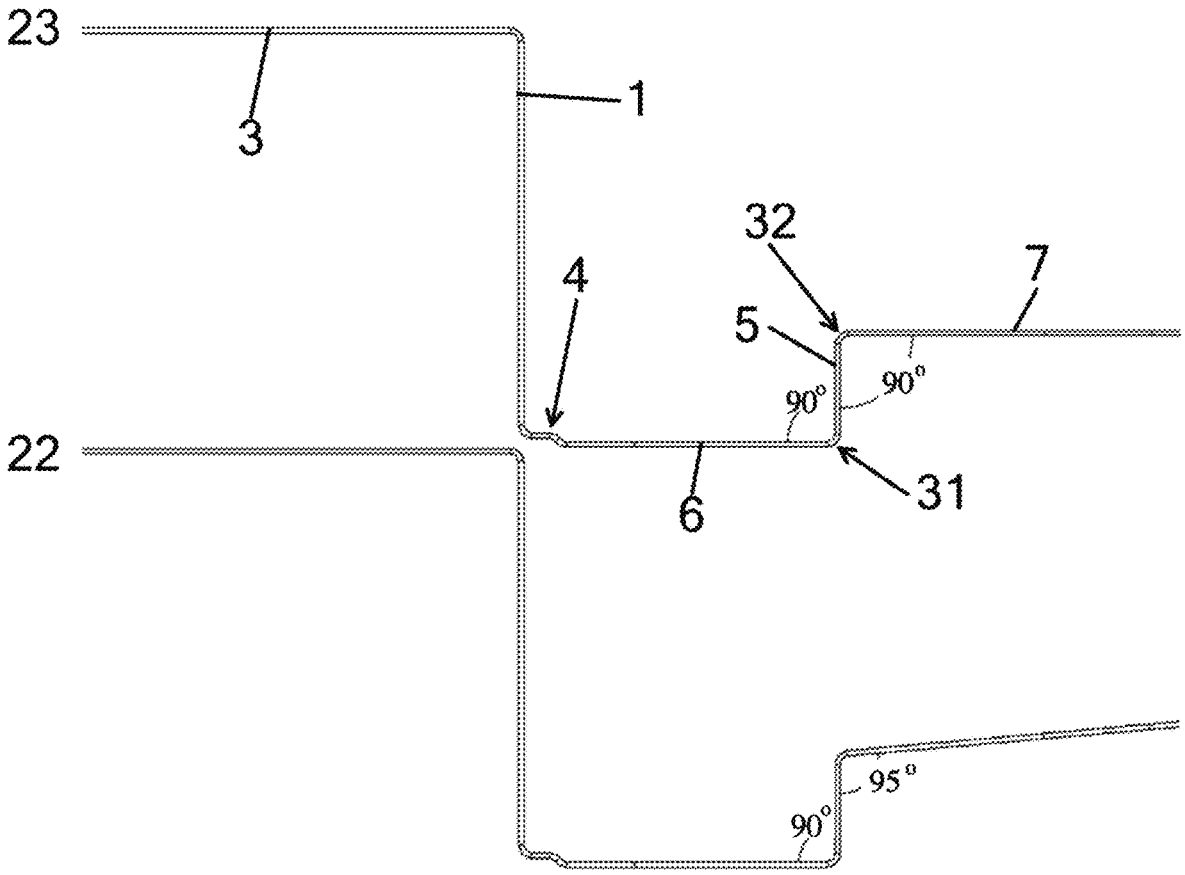
Figure 14:
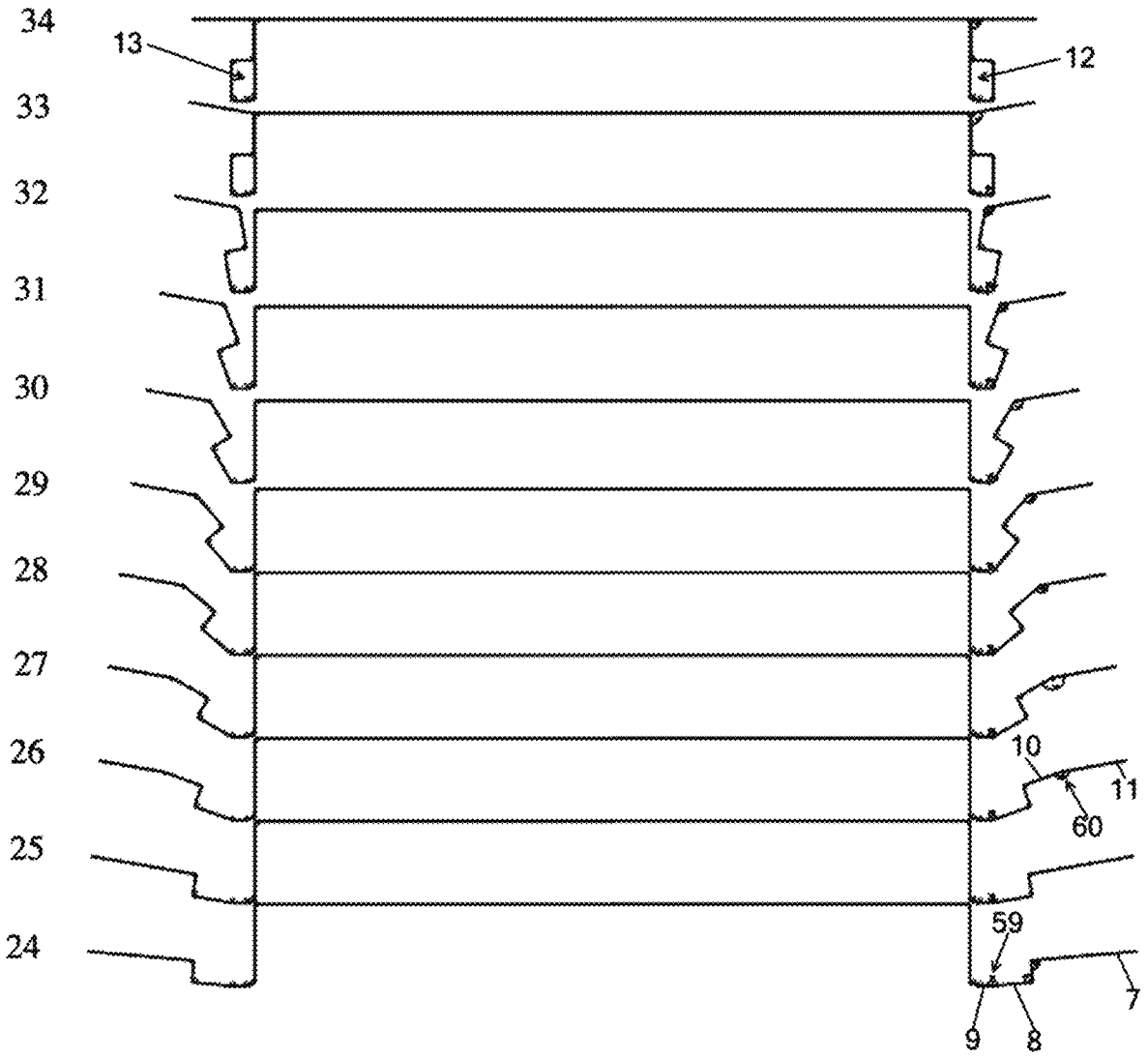
FIG. 14 is a schematic diagram of 24th to 34th passes of forming in a method for manufacturing a rollforming frame in an embodiment.
Figure 15:
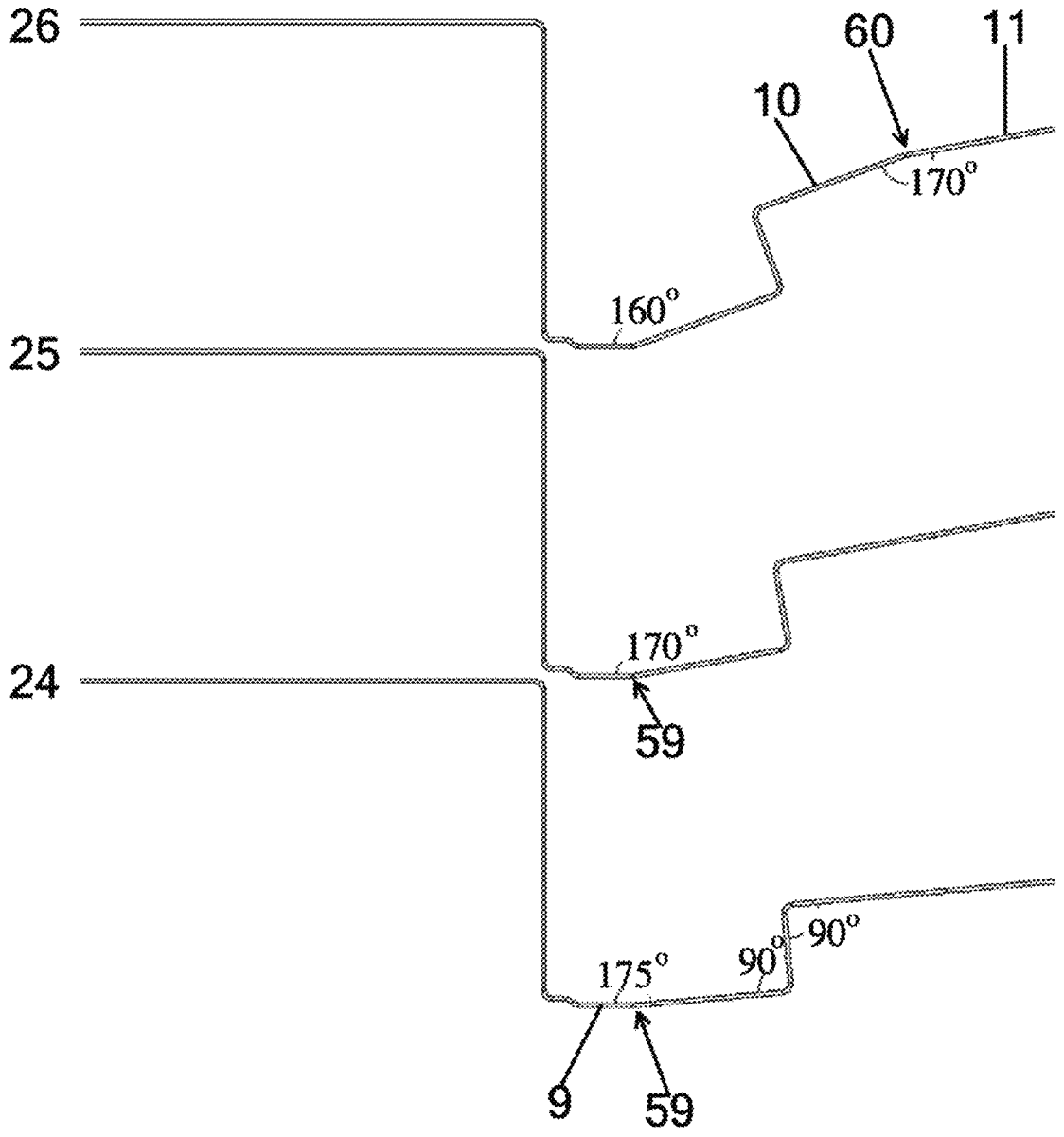
FIGS. 15 to 18 are schematic diagrams of angles for 24th to 34th passes of forming.
Figure 16:
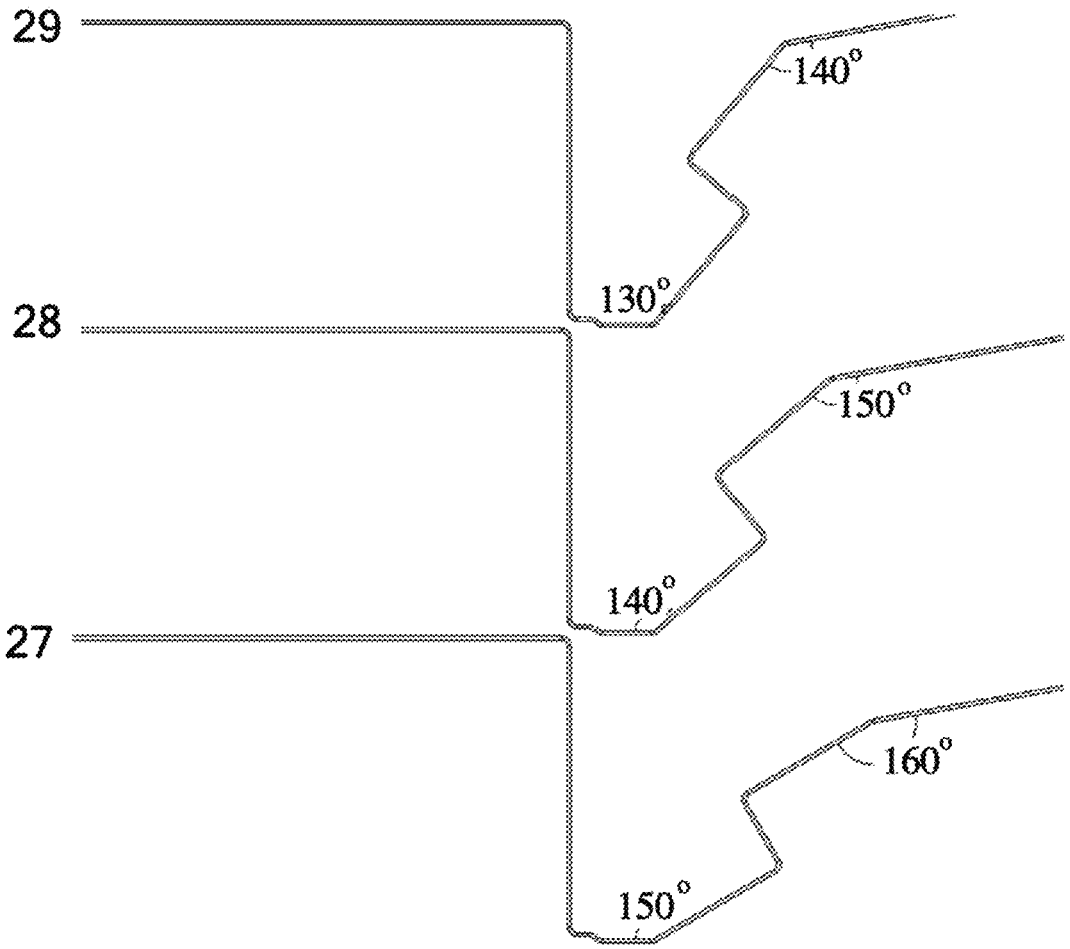
Figure 17:
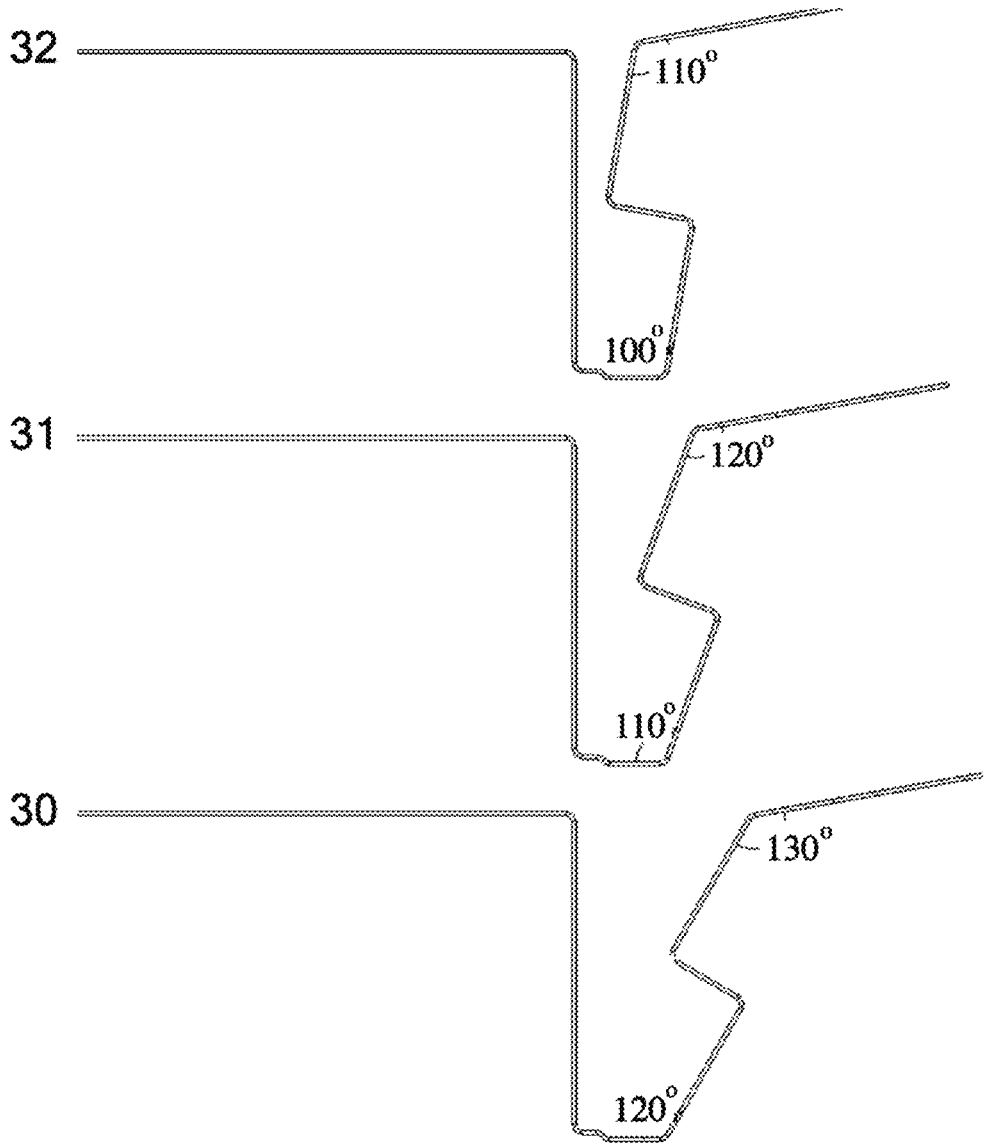
Figure 18:
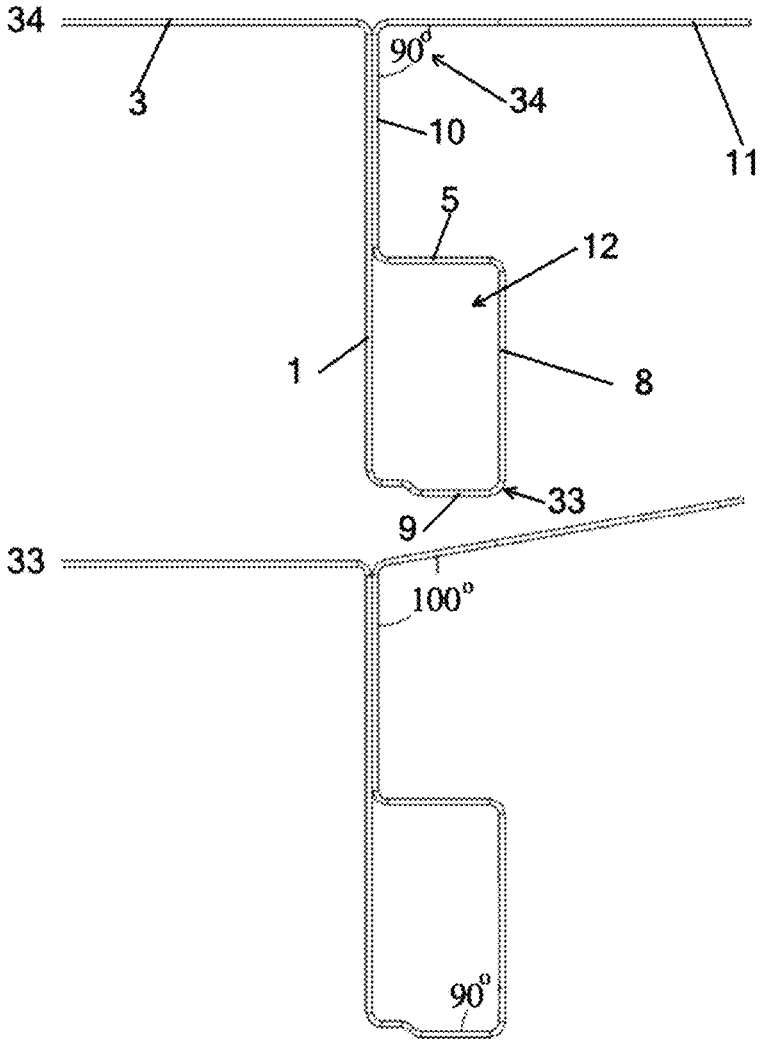
Figure 19:
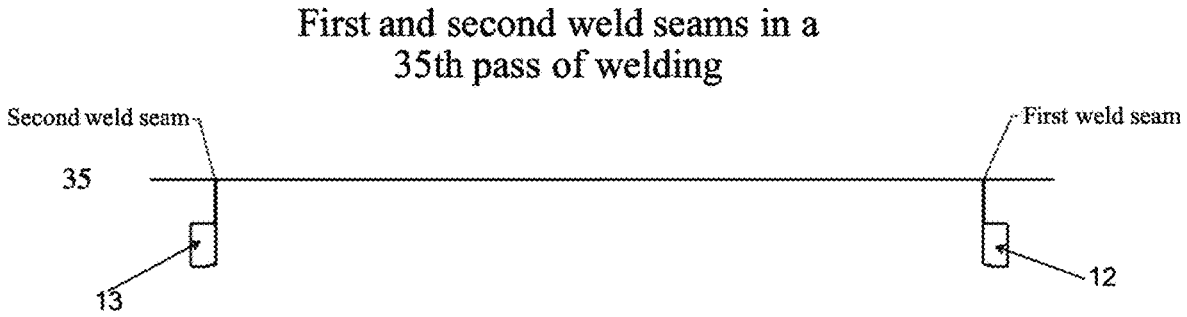
FIG. 19 is a schematic diagram of welding during a 35th pass of forming in a method for manufacturing a rollforming frame in an embodiment.
Figure 20:
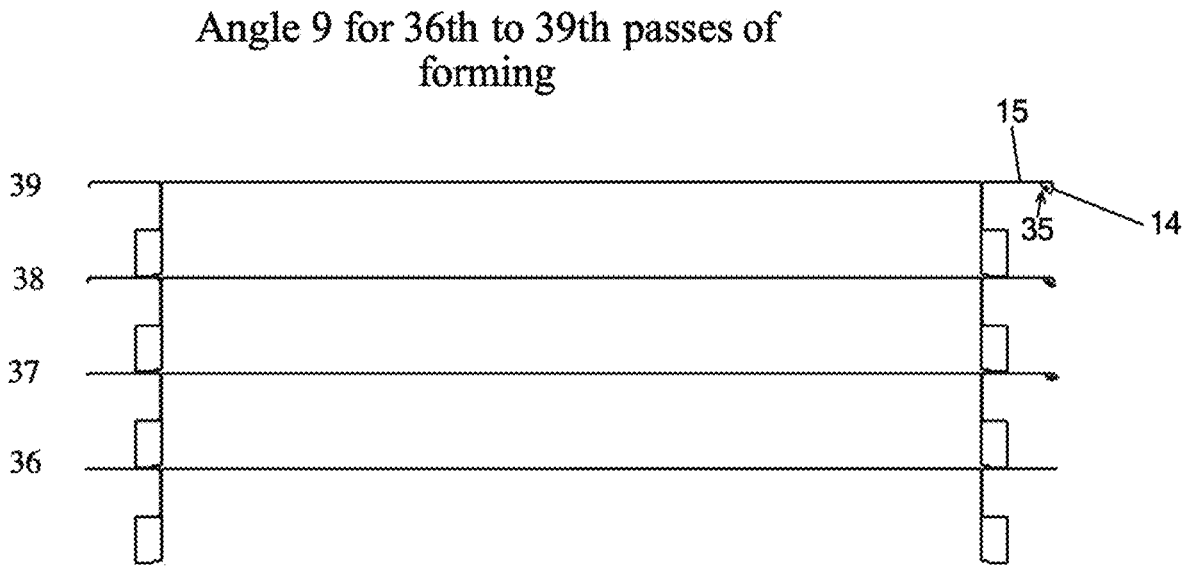
FIG. 20 is a schematic diagram of 36th to 39th passes of forming in a method for manufacturing a rollforming frame in an embodiment.
Figure 21:
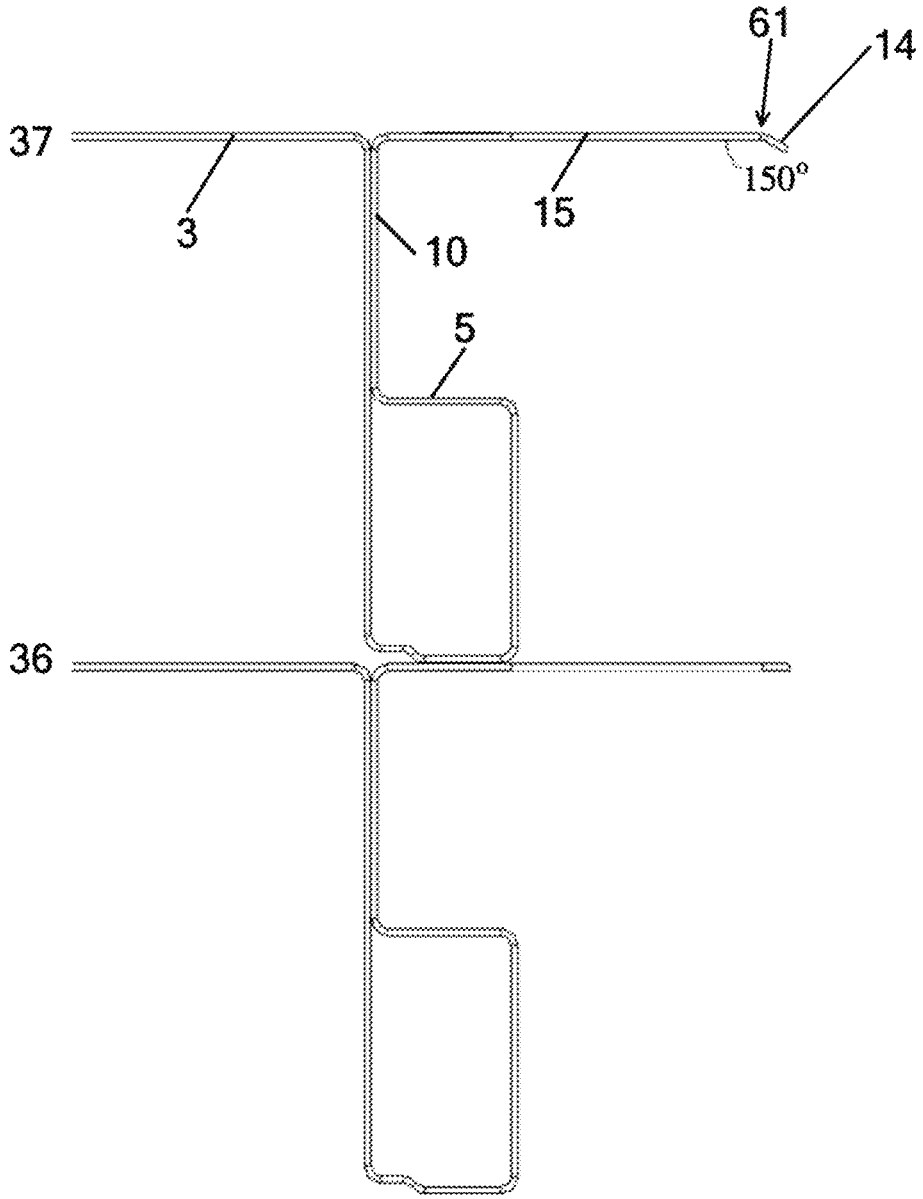
FIGS. 21 and 22 are schematic diagrams of angles for 36th to 39th passes of forming.
Figure 22:
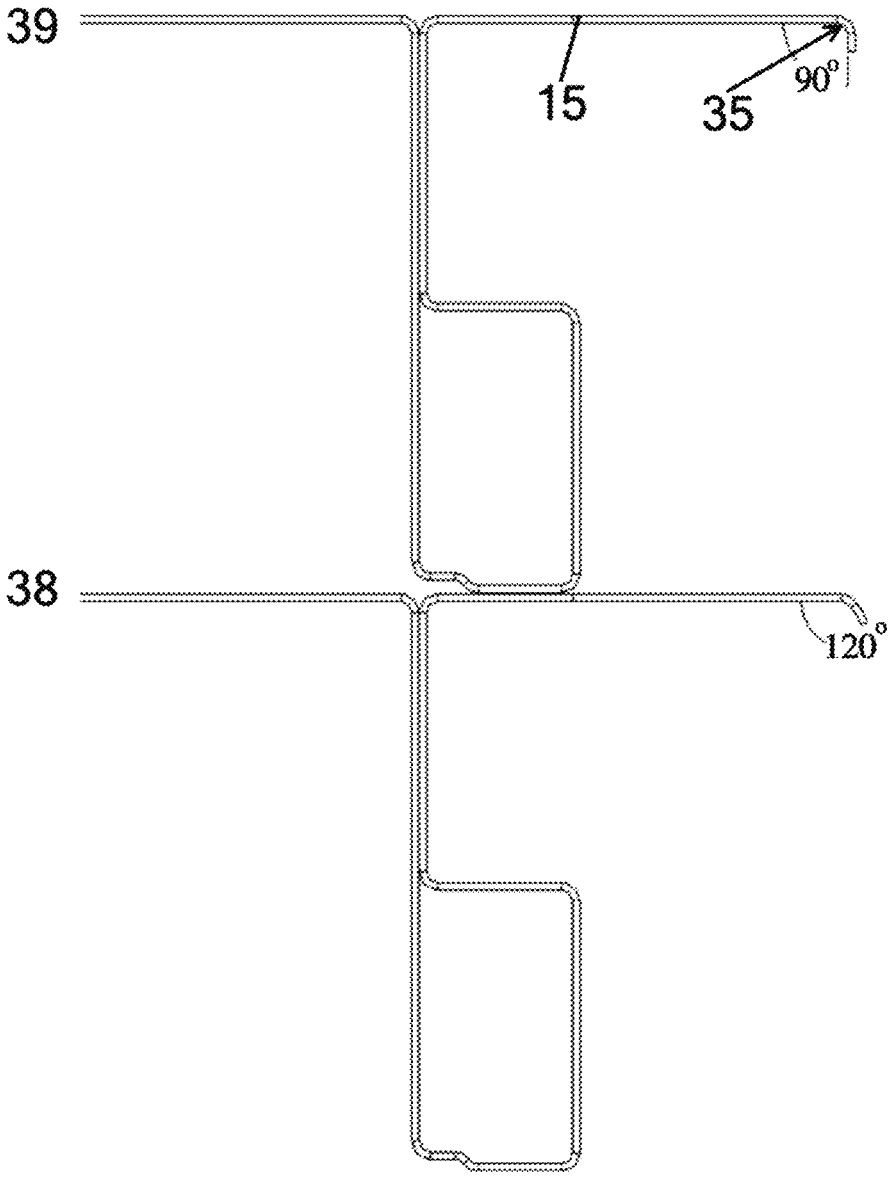
Figure 23:
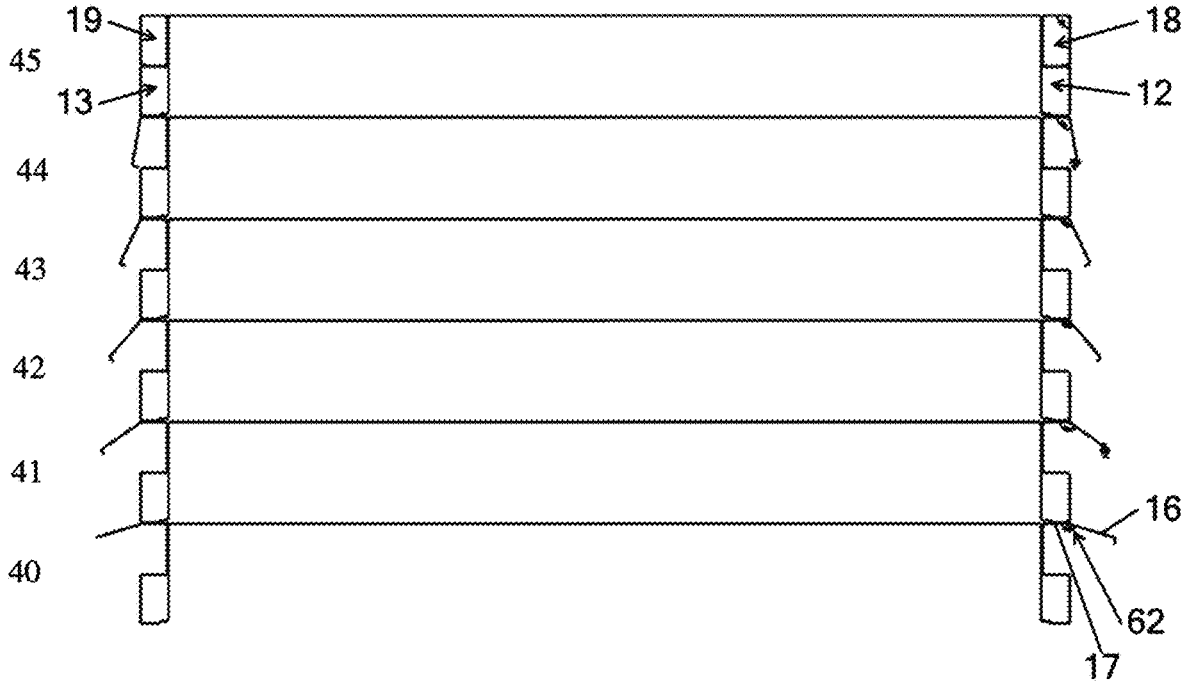
FIG. 23 is a schematic diagram of 40th to 45th passes of forming in a method for manufacturing a rollforming frame in an embodiment.
Figure 24:
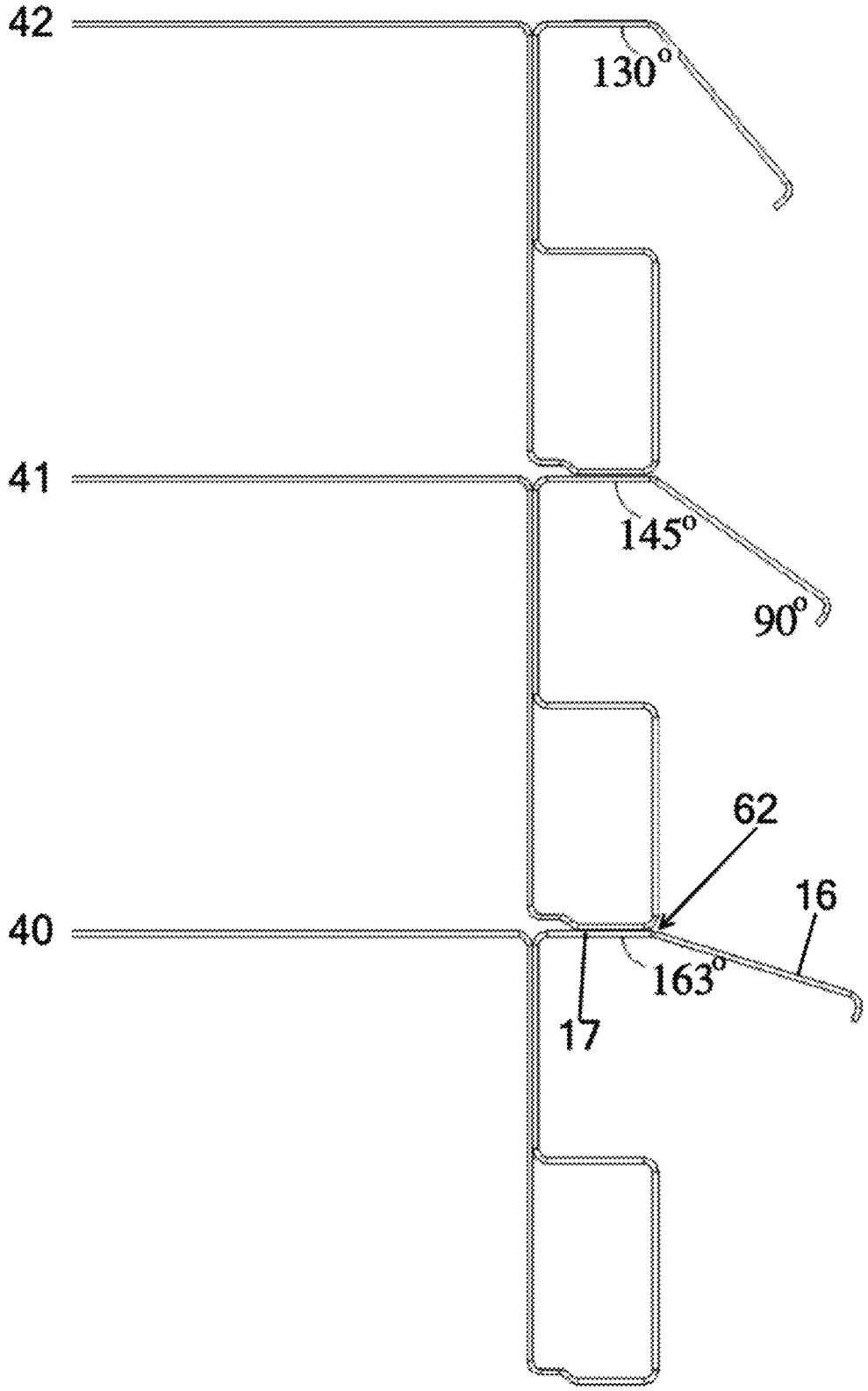
FIGS. 24 and 25 are schematic diagrams of angles for 40th to 45th passes of forming.
Figure 25:
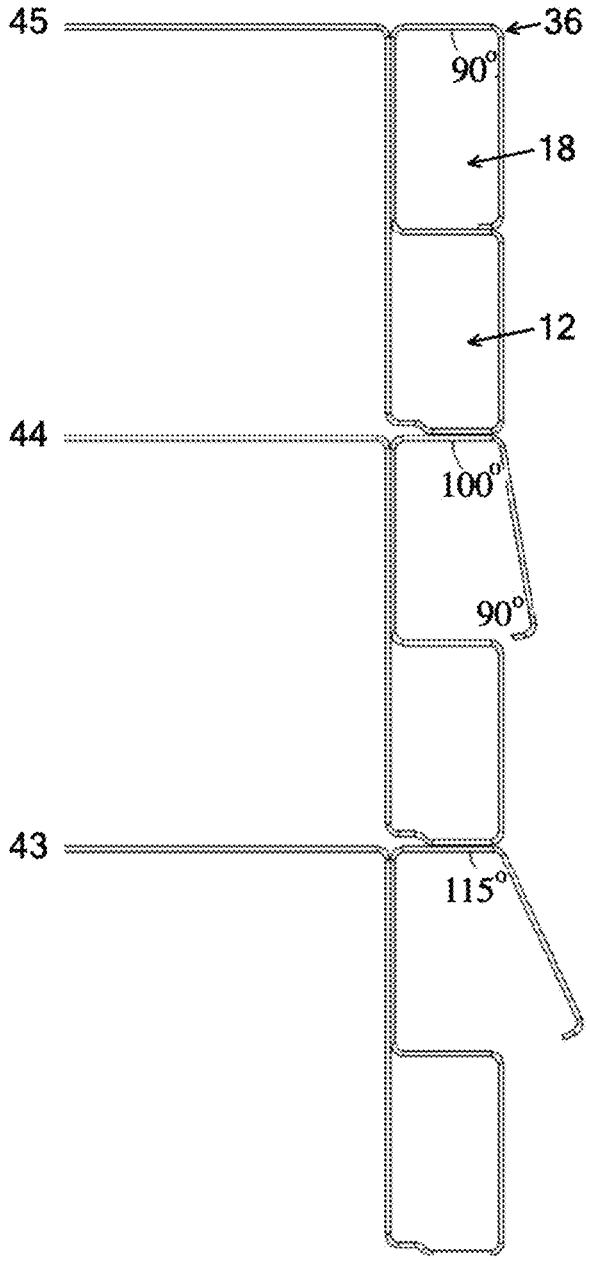
Figure 26:
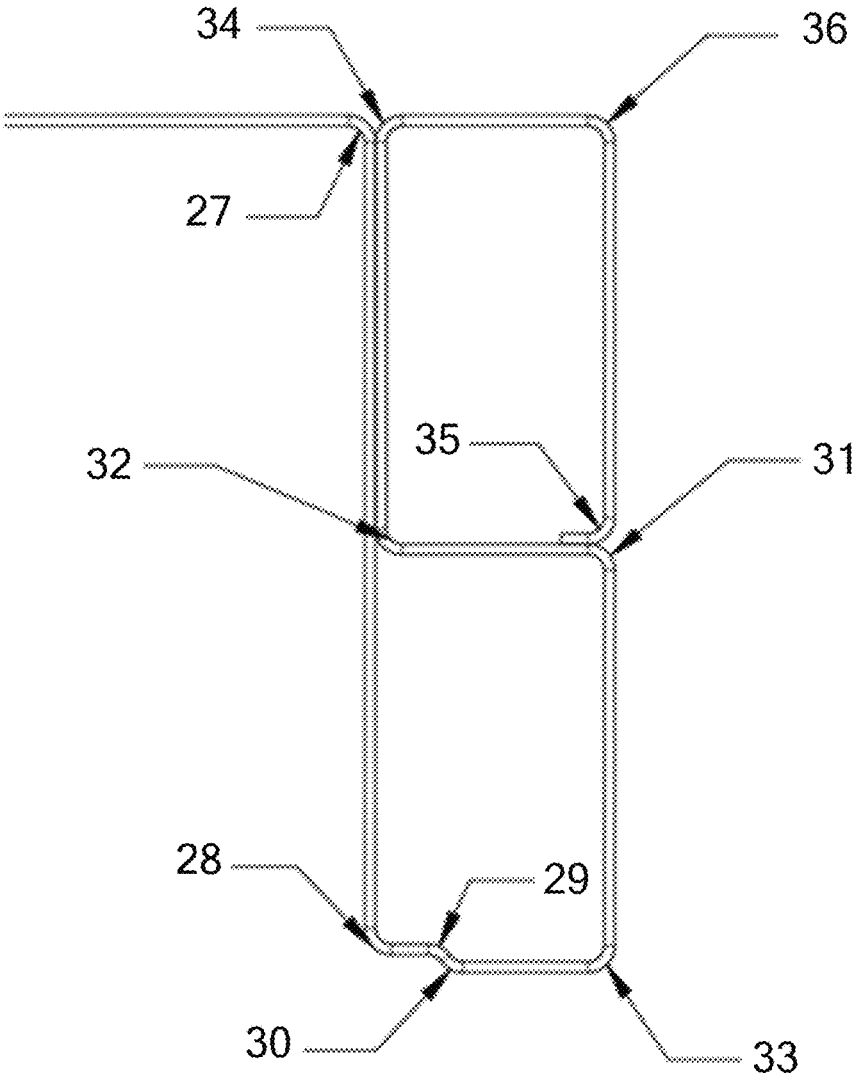
FIG. 26 is a schematic structural diagram of all bend structures.
Figure 27:
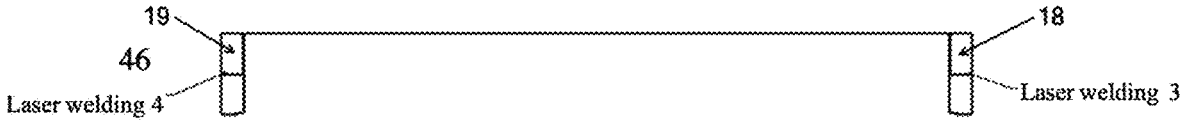
FIG. 27 is a schematic diagram of welding during a 46th pass of forming in a method for manufacturing a rollforming frame in an embodiment.
Figure 28:
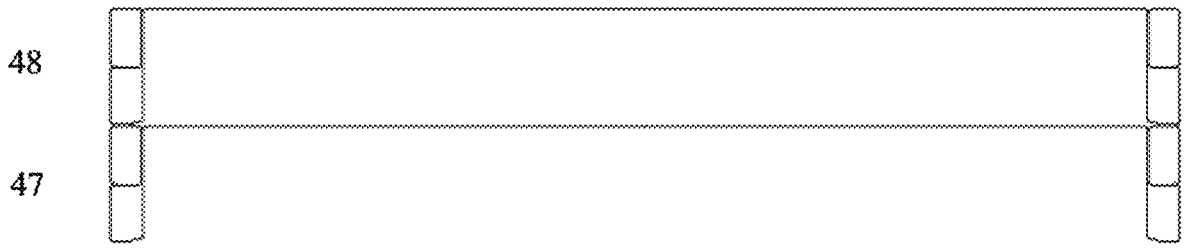
FIG. 28 is a schematic diagram of shaping during 47th and 48th passes of forming in a method for manufacturing a rollforming frame in an embodiment.

| | | |
|---|---|---|
| first vertical wall 1 | stepped planar structure 22 | ninth horizontal wall 43 |
| first horizontal wall 2 | third side edge structure 23 | twelfth bend structure 44 |
| bottom plate 3 | stepped inclined surface structure 24 | eighth vertical wall 45 |
| stepped bent structure 4 | fourth side edge structure 25 | tenth horizontal wall 46 |
| second vertical wall 5 | fifth side edge structure 26 | thirteenth bend structure 47 |
| second horizontal wall 6 | first bend structure 27 | fourteenth bend structure 48 |
| third horizontal wall 7 | second bend structure 28 | left transverse beam portion 49 |
| third vertical wall 8 | third bend structure 29 | right transverse beam portion 50 |
| fourth horizontal wall 9 | fourth bend structure 30 | front transverse beam portion 51 |
| fourth vertical wall 10 | fifth bend structure 31 | rear transverse beam portion 52 |
| fifth horizontal wall 11 | sixth bend structure 32 | first corner structure 53 |
| first cavity 12 | seventh bend structure 33 | second corner structure 54 |
| second cavity 13 | eighth bend structure 34 | third corner structure 55 |
| connecting edge 14 | ninth bend structure 35 | fourth corner structure 56 |
| sixth horizontal wall 15 | tenth bend structure 36 | |
| fifth vertical wall 16 | front transverse beam plate 37 | |
| seventh horizontal wall 17 | rear transverse beam plate 38 | |
| third cavity 18 | | |
| fourth cavity 19 | | |
| first side edge structure 20 | | |

-continued

| | | |
|---|---|---|
| second side edge structure 21 | sixth vertical wall 39<br>eighth horizontal wall 40<br>eleventh bend structure 41<br>seventh vertical wall 42 | fifth corner structure 57<br>sixth corner structure 58<br>seventh corner structure 59<br>eighth corner structure 60<br>ninth corner structure 61<br>tenth corner structure 62 |

DETAILED DESCRIPTION OF THE EMBODIMENTS

The present invention is described in detail below with reference to specific embodiments. The following embodiments will assist those skilled in the art in further understanding the present invention, but do not limit the present invention in any form. It should be pointed out that several changes and improvements may also be made by those of ordinary skill in the art without departing from the conception of the present invention. All the changes and improvements fall within the scope of protection of the present invention.

Embodiment 1

As shown in FIGS. 1 to 35, this embodiment provides a method for manufacturing a rollforming frame, including the following steps:

step 1: separately rolling and bending two opposite ends of a to-be-machined plate to separately form a first vertical wall 1 and a first horizontal wall 2 connected to each other at the two opposite ends of the to-be-machined plate, where a bottom plate 3 is formed between the two first vertical walls 1; a first bend structure 27 is formed between the first vertical wall 1 and the bottom plate 3, and a second bend structure 28 is formed between the first horizontal wall 2 and the first vertical wall 1; and the step 1 specifically includes the following steps:

step 1.1: separately rolling and bending the two opposite ends of the to-be-machined plate to form a first side edge structure 20 and a second side edge structure 21 at the two opposite ends of the to-be-machined plate respectively, where the bottom plate 3 is formed between the first side edge structure 20 and the second side edge structure 21, a first corner structure is formed between the first side edge structure 20 and the bottom plate 3, and a first corner structure 53 is formed between the second side edge structure 21 and the bottom plate 3;

step 1.2: separately rolling and bending the first side edge structure 20 and the second side edge structure 21 to form the first vertical wall 1 and the first horizontal wall 2, where a second corner structure 54 is formed between the first vertical wall 1 and the first horizontal wall 2; and step 1.3: rolling and bending the first vertical wall 1 and the first horizontal wall 2 for multiple times, gradually reducing an angle of the first corner structure 53 to form the first bend structure 27, and gradually reducing an angle of the second corner structure 54 to form the second bend structure 28, where in the step 1.1, the angle of the first corner structure 53 is 177°;

in the step 1.2, the angle of the first corner structure 53 is 170°, and the angle of the second corner structure 54 is 172°; and the step 1.3 specifically includes the following steps:

step 1.3.1: rolling and bending the first vertical wall 1 and the first horizontal wall 2, such that the angle of the first corner structure 53 is 160°, and the angle of the second corner structure 54 is 162°;

step 1.3.2: rolling and bending the first vertical wall 1 and the first horizontal wall 2, such that the angle of the first corner structure 53 is 145°, and the angle of the second corner structure 54 is 148°;

step 1.3.3: rolling and bending the first vertical wall 1 and the first horizontal wall 2, such that the angle of the first corner structure 53 is 130°, and the angle of the second corner structure 54 is 132°;

step 1.3.4: rolling and bending the first vertical wall 1 and the first horizontal wall 2, such that the angle of the first corner structure 53 is 115°, and the angle of the second corner structure 54 is 118°;

step 1.3.5: rolling and bending the first vertical wall 1 and the first horizontal wall 2, such that the angle of the first corner structure 53 is 100°, and the angle of the second corner structure 54 is 103°;

step 1.3.6: rolling and bending the first vertical wall 1 and the first horizontal wall 2, such that the angle of the first corner structure 53 is 90°, the first bend structure 27 is formed, and the angle of the second corner structure 54 is 93°; and step 1.3.7: rolling and bending the first horizontal wall 2, such that the angle of the second corner structure 54 is 90°, and the second bend structure 28 is formed;

step 2: rolling and bending one end of the first horizontal wall 2 adjacent to the first vertical wall 1 to form a stepped bent structure 4, where a third bend structure 29 and a fourth bend structure 30 are formed in the stepped bent structure 4; and the step 2 specifically includes the following steps:

step 2.1: rolling and bending one end of the first horizontal wall 2 adjacent to the first vertical wall 1 to form a stepped planar structure 22 and a third side edge structure 23, where a third corner structure 55 is formed between the stepped planar structure 22 and the third side edge structure 23;

step 2.2: rolling and bending the third side edge structure 23 to form a stepped inclined surface structure 24 and a fourth side edge structure 25, where the third corner structure 55 is formed between the stepped planar structure 22 and the stepped inclined surface structure 24, and a fourth corner structure 56 is formed between the stepped inclined surface structure 24 and the fourth side edge structure 25; and step 2.3: rolling and bending the fourth side edge structure 25 and the stepped inclined surface structure 24 for multiple times, gradually increasing an angle of the third corner structure 55 to form the third bend structure 29, and gradually increasing an angle of the fourth corner structure 56 to form the fourth bend structure 30, where in the step 2.1, the angle of the third corner structure 55 is 3°;

in the step 2.2, the angle of the third corner structure 55 is 15° and the angle of the fourth corner structure 56 is 13°; and the step 2.3 specifically includes the following steps:

step 2.3.1: rolling and bending the fourth side edge structure 25 and the stepped inclined surface structure 24, such that the angle of the third corner structure 55 is 30° and the angle of the fourth corner structure 56 is 28°;

step 2.3.2: rolling and bending the fourth side edge structure 25 and the stepped inclined surface structure 24, such that the angle of the third corner structure 55 is 45° and the angle of the fourth corner structure 56 is 42°;

step 2.3.3: rolling and bending the fourth side edge structure 25 and the stepped inclined surface structure 24, such that the angle of the third corner structure 55 is 54°, the third bend structure 29 is formed, and the angle of the fourth corner structure 56 is 52°; and step 2.3.4: rolling and bending the fourth side edge structure 25, such that the angle of the fourth corner structure 56 is 54° and the fourth bend structure 30 is formed;

step 3: rolling and bending the first horizontal wall 2 to form a second vertical wall 5, a second horizontal wall 6, and a third horizontal wall 7 that are connected, where two ends of the second horizontal wall 6 are connected to the stepped bent structure 4 and the second vertical wall 5 respectively, a fifth bend structure 31 is formed between the second horizontal wall 6 and the second vertical wall 5, and a sixth bend structure 32 is formed between the second vertical wall 5 and the third horizontal wall 7; and the step 3 specifically includes the following steps:

step 3.1: rolling and bending the first horizontal wall 2 to form the second horizontal wall 6 and a fifth side edge structure 26, where a fifth corner structure 57 is formed between the second horizontal wall 6 and the fifth side edge structure 26;

step 3.2: rolling and bending the fifth side edge structure 26 to form the second vertical wall 5 and the third horizontal wall 7, where the fifth corner structure 57 is formed between the second horizontal wall 6 and the second vertical wall 5, and a sixth corner structure 58 is formed between the second vertical wall 5 and the third horizontal wall 7; and step 3.3: rolling and bending the second vertical wall 5 and the third horizontal wall 7 for multiple times, gradually reducing an angle of the fifth corner structure 57 to form the fifth bend structure 31, and gradually reducing an angle of the sixth corner structure 58 to form the sixth bend structure 32, where in the step 3.1, the angle of the fifth corner structure 57 is 176°;

in the step 3.2, the angle of the fifth corner structure 57 is 165° and the angle of the sixth corner structure 58 is 170°; and the step 3.3 specifically includes the following steps:

step 3.3.1: rolling and bending the second vertical wall 5 and the third horizontal wall 7, such that the angle of the fifth corner structure 57 is 150°, and the angle of the sixth corner structure 58 is 155°;

step 3.3.2: rolling and bending the second vertical wall 5 and the third horizontal wall 7, such that the angle of the fifth corner structure 57 is 135°, and the angle of the sixth corner structure 58 is 140°;

step 3.3.3: rolling and bending the second vertical wall 5 and the third horizontal wall 7, such that the angle of the fifth corner structure 57 is 120°, and the angle of the sixth corner structure 58 is 125°;

step 3.3.4: rolling and bending the second vertical wall 5 and the third horizontal wall 7, such that the angle of the fifth corner structure 57 is 105°, and the angle of the sixth corner structure 58 is 110°;

step 3.3.5: rolling and bending the second vertical wall 5 and the third horizontal wall 7, such that the angle of the fifth corner structure 57 is 90°, the fifth bend structure 31 is formed, and the angle of the sixth corner structure 58 is 95°; and step 3.3.6: rolling and bending the third horizontal wall 7, such that the angle of the sixth corner structure 58 is 90°, and the angle of the sixth bend structure 32 is formed;

step 4: rolling and bending the second horizontal wall 6 to form a third vertical wall 8 and a fourth horizontal wall 9 connected to each other; and rolling and bending the third horizontal wall 7 to form a fourth vertical wall 10 and a fifth horizontal wall 11 connected to each other, where the fourth vertical wall 10 abuts against the first vertical wall 1; a seventh bend structure 33 is formed between the third vertical wall 8 and the fourth horizontal wall 9, and two ends of the fourth horizontal wall 9 are connected to the stepped bent structure 4 and the third vertical wall 8 respectively; an eighth bend structure 34 is formed between the fourth vertical wall 10 and the fifth horizontal wall 11, and two ends of the fourth vertical wall 10 are connected to the fifth horizontal wall 11 and the second vertical wall 5 respectively; and the step 4 specifically includes the following steps:

step 4.1: rolling and bending the second horizontal wall 6 to form the third vertical wall 8 and the fourth horizontal wall 9, where a seventh corner structure 59 is formed between the third vertical wall 8 and the fourth horizontal wall 9;

step 4.2: rolling and bending the third vertical wall 8, and reducing an angle of the seventh corner structure 59 for the first time;

step 4.3: rolling the third horizontal wall 7 to form the fourth vertical wall 10 and the fifth horizontal wall 11, where an eighth corner structure 60 is formed between the fourth vertical wall 10 and the fifth horizontal wall 11; and rolling and bending the third vertical wall 8, and reducing the angle of the seventh corner structure 59 for the second time; and step 4.4: rolling and bending the fifth horizontal wall 11 and the third vertical wall 8 for multiple times, gradually reducing the angle of the seventh corner structure 59 to form the seventh bend structure 33, and gradually reducing an angle of the eighth corner structure 60 to form the eighth bend structure 34, where in the step 4.1, the angle of the seventh corner structure 59 is 175°;

in the step 4.2, the angle of the seventh corner structure 59 is 170°;

in the step 4.3, the angle of the seventh corner structure 59 is 160°, and the angle of the eighth corner structure 60 is 170°; and the step 4.4 specifically includes the following steps:

step 4.4.1: rolling and bending the fifth horizontal wall 11 and the third vertical wall 8, such that the angle of the seventh corner structure 59 is 150°, and the angle of the eighth corner structure 60 is 160°;

step 4.4.2: rolling and bending the fifth horizontal wall 11 and the third vertical wall 8, such that the angle of the seventh corner structure 59 is 140°, and the angle of the eighth corner structure 60 is 150°;

step 4.4.3: rolling and bending the fifth horizontal wall 11 and the third vertical wall 8, such that the angle of the seventh corner structure 59 is 130°, and the angle of the eighth corner structure 60 is 140°;

step 4.4.4: rolling and bending the fifth horizontal wall 11 and the third vertical wall 8, such that the angle of the seventh corner structure 59 is 120°, and the angle of the eighth corner structure 60 is 130°;

step 4.4.5: rolling and bending the fifth horizontal wall 11 and the third vertical wall 8, such that the angle of the seventh corner structure 59 is 110°, and the angle of the eighth corner structure 60 is 120°;

step 4.4.6: rolling and bending the fifth horizontal wall 11 and the third vertical wall 8, such that the angle of the seventh corner structure 59 is 100°, and the angle of the eighth corner structure 60 is 110°;

step 4.4.7: rolling and bending the fifth horizontal wall 11 and the third vertical wall 8, such that the angle of the seventh corner structure 59 is 90°, the seventh bend structure 33 is formed, and the angle of the eighth corner structure 60 is 100°; and step 4.4.8: rolling and bending the fifth horizontal wall 11, such that the angle of the eighth corner structure 60 is 90°, and the eighth bend structure 34 is formed;

step 5: performing laser welding on a joint of the fourth vertical wall 10 and the first vertical wall 1, where the second vertical wall 5, the third vertical wall 8, the fourth horizontal wall 9, and the first vertical wall 1 form a first cavity 12 and a second cavity 13;

step 6: rolling and bending one end of the fifth horizontal wall 11 away from the fourth vertical wall 10 to form a connecting edge 14 and a sixth horizontal wall 15 connected to each other, where a ninth corner structure 35 is formed between the connecting edge 14 and the sixth horizontal wall 15; and the step 6 specifically includes the following steps:

step 6.1: rolling and bending one end of the fifth horizontal wall 11 away from the fourth vertical wall 10 to form the connecting edge 14 and the sixth horizontal wall 15, where a ninth corner structure 61 is formed between the connecting edge 14 and the sixth horizontal wall 15; and step 6.2: rolling and bending the connecting edge 14 for multiple times, and gradually reducing an angle of the ninth corner structure 61 to form the ninth bend structure 35, where in the step 6.1, the angle of the ninth corner structure 61 is 180°; and the step 6.2 specifically includes the following steps:

step 6.2.1: rolling and bending the connecting edge 14, such that the angle of the ninth corner structure 61 is 150°;

step 6.2.2: rolling and bending the connecting edge 14, such that the angle of the ninth corner structure 61 is 120°; and step 6.2.3: rolling and bending the connecting edge 14, such that the angle of the ninth corner structure 61 is 90°, and the ninth bend structure 35 is formed;

step 7: rolling and bending the sixth horizontal wall 15 to form a fifth vertical wall 16 and a seventh horizontal wall 17 connected to each other, where the connecting edge 14 abuts against the second vertical wall 5; a tenth bend structure 36 is formed between the fifth vertical wall 16 and the seventh horizontal wall 17, and two ends of the fifth vertical wall 16 are connected to the seventh horizontal wall 17 and the connecting edge 14 respectively; and the step 7 specifically includes the following steps:

step 7.1: rolling and bending the sixth horizontal wall 15 to form the fifth vertical wall 16 and the seventh horizontal wall 17, where a tenth corner structure 62 is formed between the fifth vertical wall 16 and the seventh horizontal wall 17; and step 7.2: rolling and bending the fifth vertical wall 16 for multiple times, and gradually reducing an angle of the tenth corner structure 62 to form the tenth bend structure 36, where in the step 7.1, the angle of the tenth corner structure 62 is 163°; and the step 7.2 specifically includes the following steps:

step 7.2.1: rolling and bending the fifth vertical wall 16, such that the angle of the tenth corner structure 62 is 145°;

step 7.2.2: rolling and bending the fifth vertical wall 16, such that the angle of the tenth corner structure 62 is 130°;

step 7.2.3: rolling and bending the fifth vertical wall 16, such that the angle of the tenth corner structure 62 is 115°;

step 7.2.4: rolling and bending the fifth vertical wall 16, such that the angle of the tenth corner structure 62 is 100°; and step 7.2.5: rolling and bending the fifth vertical wall 16, such that the angle of the tenth corner structure 62 is 90°, and the tenth bend structure 36 is formed;

step 8: performing laser welding on a joint of the connecting edge 14 and the second vertical wall 5, where the fourth vertical wall 10, the fifth vertical wall 16, the seventh horizontal wall 17, and the second vertical wall 5 form a third cavity 18 and a fourth cavity 19, where a left longitudinal beam portion 49 and a right longitudinal beam portion 50 are formed at the two opposite ends of the bottom plate 3.

The method for manufacturing a rollforming frame further includes the following steps:

step 9: cutting the left longitudinal beam portion 49 and the right longitudinal beam portion 50 that are located at four corners of the bottom plate 3 to form a front longitudinal beam plate 37 and a rear longitudinal beam plate 38 at another two opposite ends of the bottom plate 3;

step 10: separately bending the front longitudinal beam plate 37 and the rear longitudinal beam plate 38 to form a sixth vertical wall 39 and an eighth horizontal wall 40, where an eleventh bend structure 41 is formed between the sixth vertical wall 39 and the eighth horizontal wall 40;

step 11: bending the eighth horizontal wall 40 to form a seventh vertical wall 42 and a ninth horizontal wall 43, where a twelfth bend structure 44 is formed between the seventh vertical wall 42 and the ninth horizontal wall 43;

step 12: bending the seventh vertical wall 42 to form an eighth vertical wall 45 and a tenth horizontal wall 46, where a thirteenth bend structure 47 is formed between the eighth vertical wall 45 and the tenth horizontal wall 46;

step 13: bending the ninth horizontal wall 43, such that the sixth vertical wall 39 abuts against the bottom plate 3, a fourteenth bend structure 48 is formed between the ninth horizontal wall 43 and the bottom plate 3, and a front longitudinal beam portion 51 and a rear longitudinal beam portion 52 are formed at the another two opposite ends of the bottom plate 3; and step 14: welding a joint of the front longitudinal beam portion 51 and the left longitudinal beam portion 49, welding a joint of the front longitudinal beam portion 51 and the right longitudinal beam portion 50, welding a joint of the rear longitudinal beam portion 52 and the left longitudinal beam portion 49, welding a joint of the rear longitudinal beam portion 52 and the right longitudinal beam portion 50, and welding a joint of the sixth vertical wall 39 and the bottom plate 3.

This embodiment further provides a rollforming frame manufactured using the above method for manufacturing a rollforming frame.

The rollforming frame provided in this embodiment includes a bottom plate 3, a left longitudinal beam portion 49, and a right longitudinal beam portion 50, where the left longitudinal beam portion 49 and the right longitudinal beam portion 50 are disposed at two opposite ends of the bottom plate 3 respectively; each of the left longitudinal beam portion 49 and the right longitudinal beam portion 50 includes the first vertical wall 1, the fourth horizontal wall 9, the third vertical wall 8, the second vertical wall 5, the fourth vertical wall 10, the seventh horizontal wall 17, the fifth vertical wall 16, and the connecting edge 14 that are sequentially connected, the fourth horizontal wall 9, the third vertical wall 8, and the second vertical wall 5 form a first notch structure, the second vertical wall 5, the fourth vertical wall 10, and the seventh horizontal wall 17 form a second notch structure, the first vertical wall 1 is connected to an opening end of the first notch structure, the fourth vertical wall 10 is connected to the first vertical wall 1, the fifth vertical wall 16 is connected to an opening end of the second notch structure, and the connecting edge 14 is connected to one end of the second vertical wall 5 adjacent to the third vertical wall 8.

In this embodiment, a high-strength steel strip is used as a raw material, each of two sides of the steel strip is designed to be provided with a special-shaped cavity in a rectangular shape with a vertical line in the middle, the middle of the cavity is provided with a bottom structure that is a steel plate, and the cavities in the two sides and the bottom structures are integrally formed, where the cavity is laser-welded and a machining technology is roll forming.

On the basis of the above integrally rolled profile, the steel plates at front and rear ends are machined using a bending technology to form predetermined cavities, then a joint is welded, and finally an integrally formed frame is formed.

Embodiment 2

Those skilled in the art can understand this embodiment as a more specific description of Embodiment 1.

This embodiment provides a method for manufacturing a rollforming frame. High-strength steel with the strength of 600 MPa or above is used as a material to achieve light weight of the material.

According to the manufacturing method in this embodiment, a steel strip passes through a roll forming mold; then, a plurality of cavities are formed on a left side and a right side of the steel strip by rolling respectively; the cavities are connected as a whole by the steel strip to serve as a bottom plate of a battery frame, where the left and right cavities are longitudinal beams, configured to support the frame and prevent collision; front and rear steel strips are formed into front and rear single-cavity transverse beams through a bending technology; and finally welding is performed to form the integrally rolled battery frame.

The manufacturing method in this embodiment includes the following steps.

In 1st to 9th passes, two vertical walls are gradually formed by a roller, two horizontal plates are distributed in a left-right manner, a lower steel strip is formed into a bottom plate, two sides of the bottom plate are connected, and finally a "hat" shape is formed;

left and right bends 1 # are formed, and optimal angles for the 1st to 8th passes are 177°, 170°, 160°, 145°, 130°, 115°, 100°, and 90° in sequence; and left and right bends 2 # are formed, and optimal angles for the 2nd to 9th passes are 172°, 162°, 148°, 132°, 118°, 103°, 93°, and 90° in sequence.

In 10th to 15th passes, the left and right horizontal plates are gradually roll-formed by the roller, and finally a stepped structure is formed;

left and right bends 3 # are formed, and optimal angles for the 10th to 14th passes are 3°, 15°, 30°, 45°, and 54° in sequence;

left and right bends 4 # are formed, and optimal angles for the 11st to 15th passes are 13°, 28°, 42°, 52°, and 54° in sequence; and a step can be formed after bending by the roller, has the optimal height of 2 mm, and is configured to mount a sealing strip and/or a sealing adhesive.

In 16th to 23rd passes, the left and right horizontal plates continue being roll-forming by the roller, and finally left and right second vertical walls and second horizontal walls are formed;

left and right bends 5 # are formed, and optimal angles for the 16th to 22nd passes are 176°, 165°, 150°, 135°, 120°, 105°, and 90° in sequence; and left and right bends 6 # are formed, and optimal angles for the 17th to 23rd passes are 170°, 155°, 140°, 125°, 110°, 95°, and 90° in sequence.

In 24th to 34th passes, horizontal edges between the step and the second vertical walls are gradually rollformed and bent by the roller, and the second horizontal edges continue being roll-formed and bent, where the second horizontal edges are bent by 90° and then are in contact with first vertical walls to form a first cavity and a second cavity;

left and right bends 7 # are formed, and optimal angles for the 24th to 33rd passes are 175°, 170°, 160°, 150°, 140°, 130°, 120°, 110°, 100°, and 90° in sequence; and left and right bends 8 # are formed, and optimal angles for the 26th to 34th passes are 170°, 160°, 150°, 140°, 130°, 120°, 110°, 100°, and 90° in sequence.

In a 35th pass of welding, contact parts between the left and right second horizontal edges and the left and right first vertical walls are gradually laser-welded by the roller to form a first cavity and a second cavity that are closed, and steel plates are formed as a whole, thereby ensuring the structural stability, strength and stiffness.

In 36th to 39th passes, the left and right second horizontal edges continue being gradually rollformed and bent by the roller, and a small weld edge is formed; and left and right bends 9 # are formed, and optimal angles for the 36th to 39th passes are 180°, 150°, 120°, and 90° in sequence.

In 40th to 45th passes, the left and right second horizontal edges and the small weld edge continue to be gradually rollformed and bent by the roller, and a bend 10 # is formed; and left and right bends 10 # are formed, and optimal angles for the 40th to 45th passes are 163°, 145°, 130°, 115°, 100°, and 90° in sequence.

In a 46th pass of welding, contact parts between the left and right second horizontal edges and left and right small weld edges are gradually laser-welded by the roller to form a third cavity and a fourth cavity that are closed, steel plates are formed as a whole, and forming of a total of four cavities is completed, thereby ensuring the structural stability, strength and stiffness.

Figure 29:
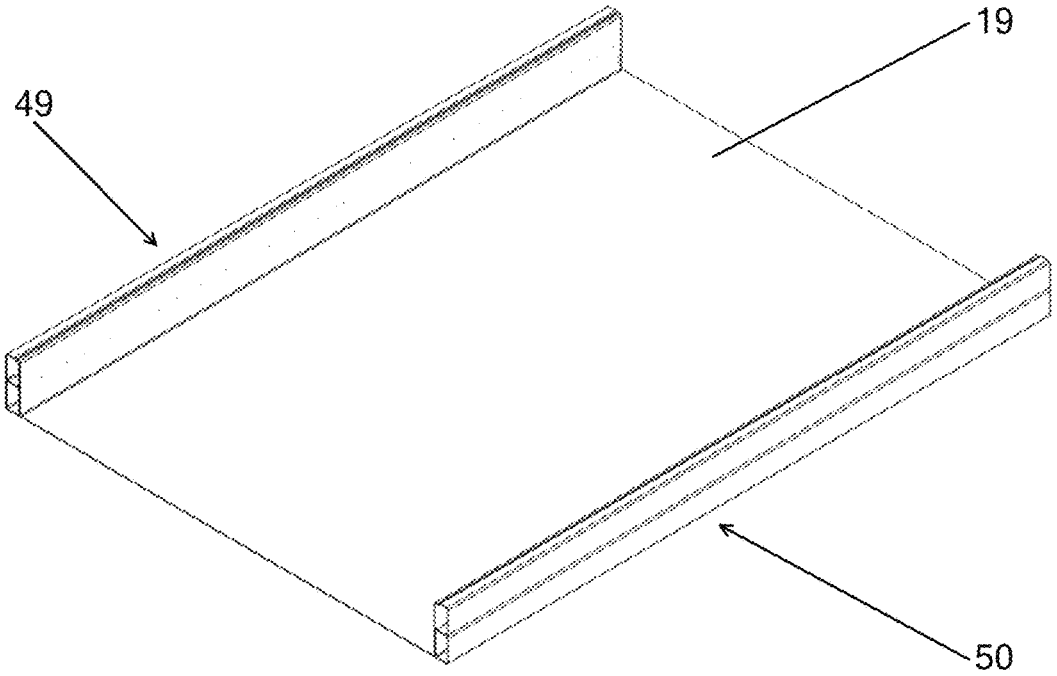
FIG. 29 is a schematic structural diagram of a rollforming frame manufactured by a method for manufacturing a rollforming frame in an embodiment.
Figure 30:
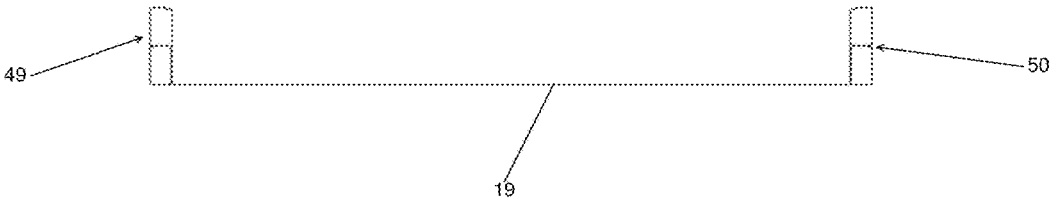
FIG. 30 is a front view of a rollforming frame manufactured by a method for manufacturing a rollforming frame in an embodiment.
Figure 31:
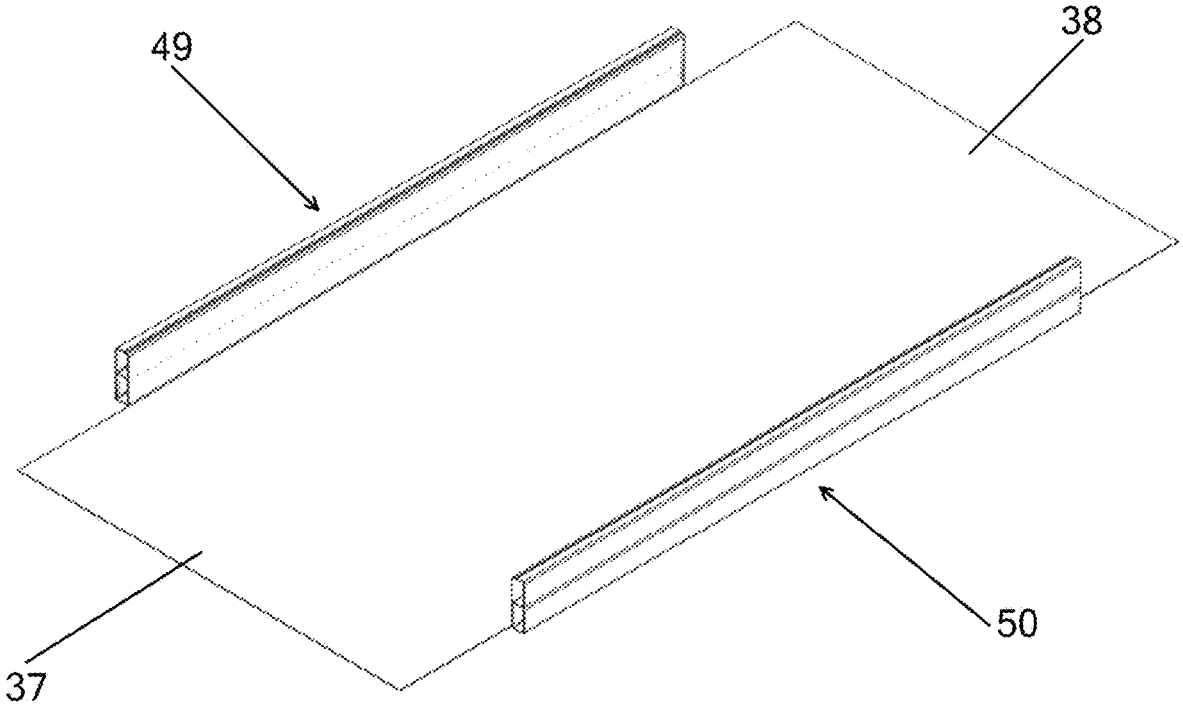
FIGS. 31 to 35 are structural diagrams of a rollforming frame in steps 9 to 14 of a method for manufacturing a rollforming frame in an embodiment.
Figure 32:
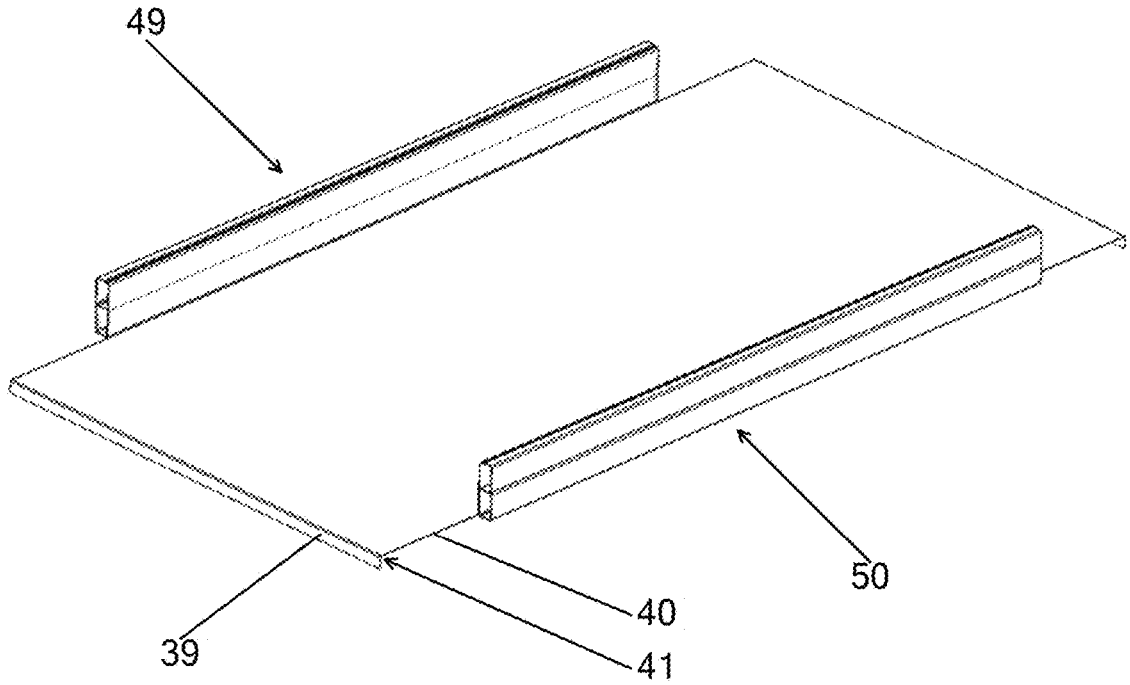
Figure 33:
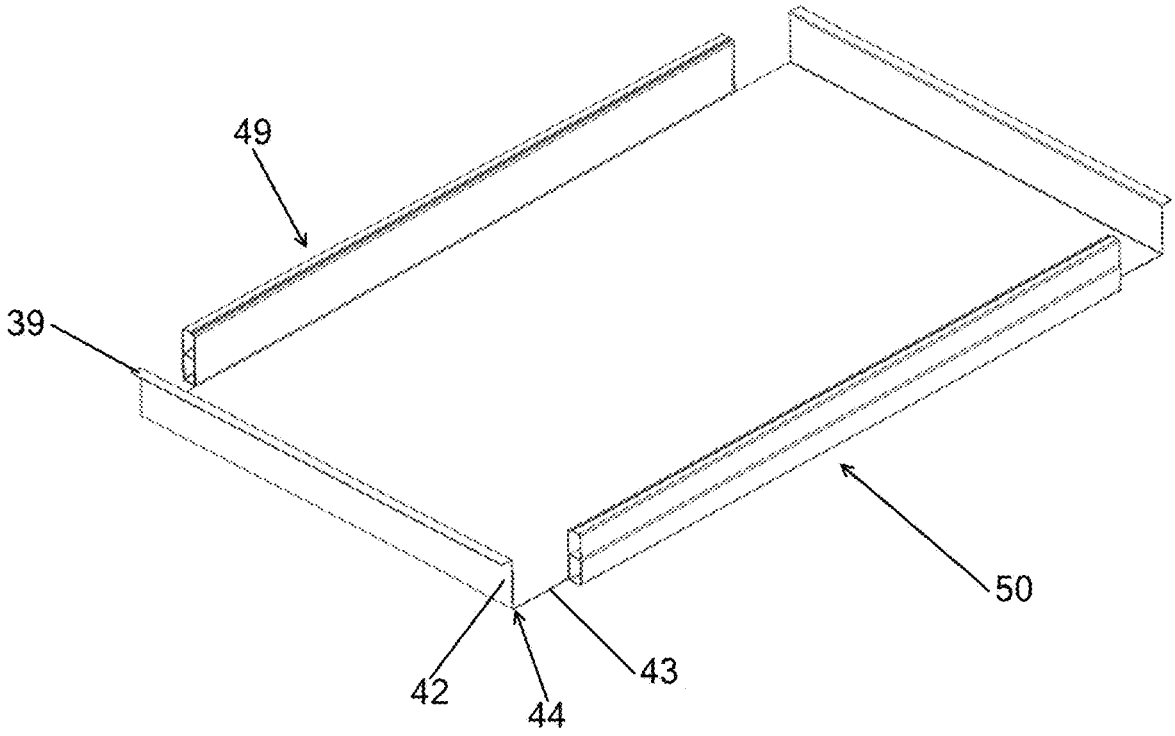
Figure 34:
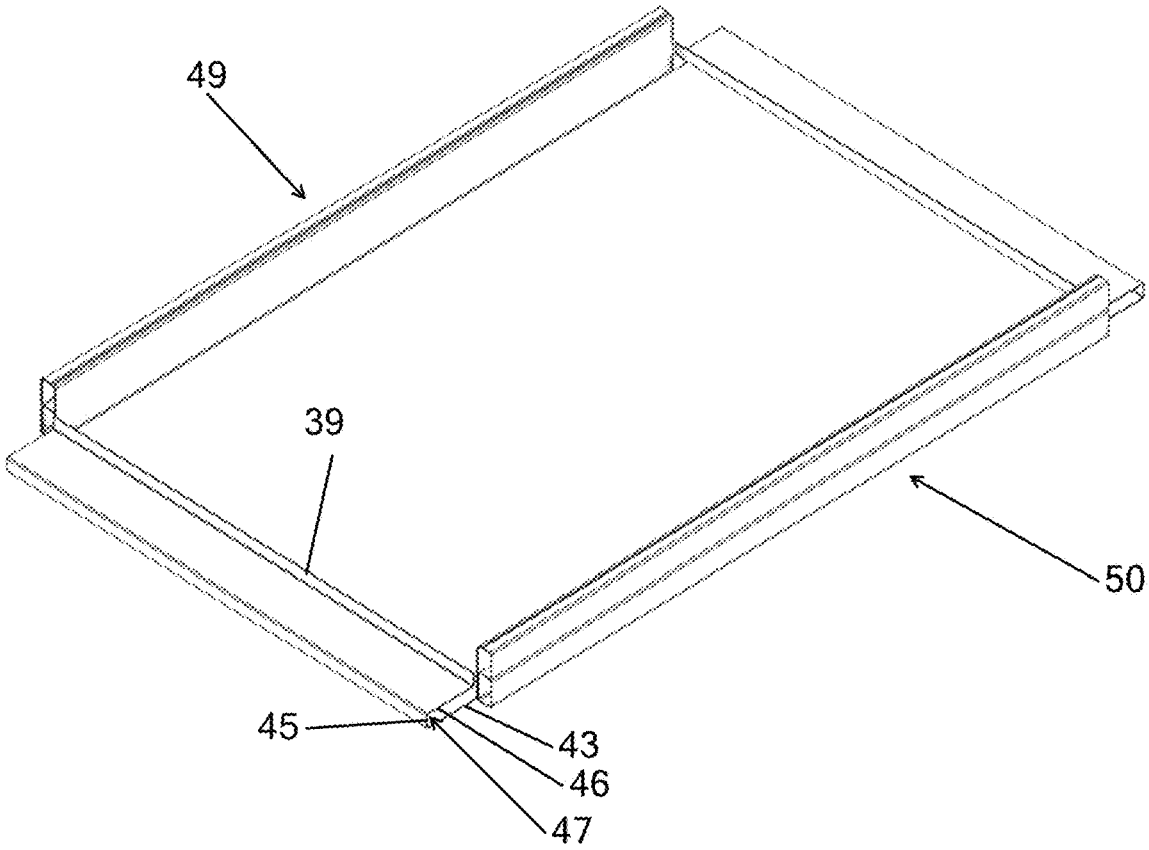
Figure 35:
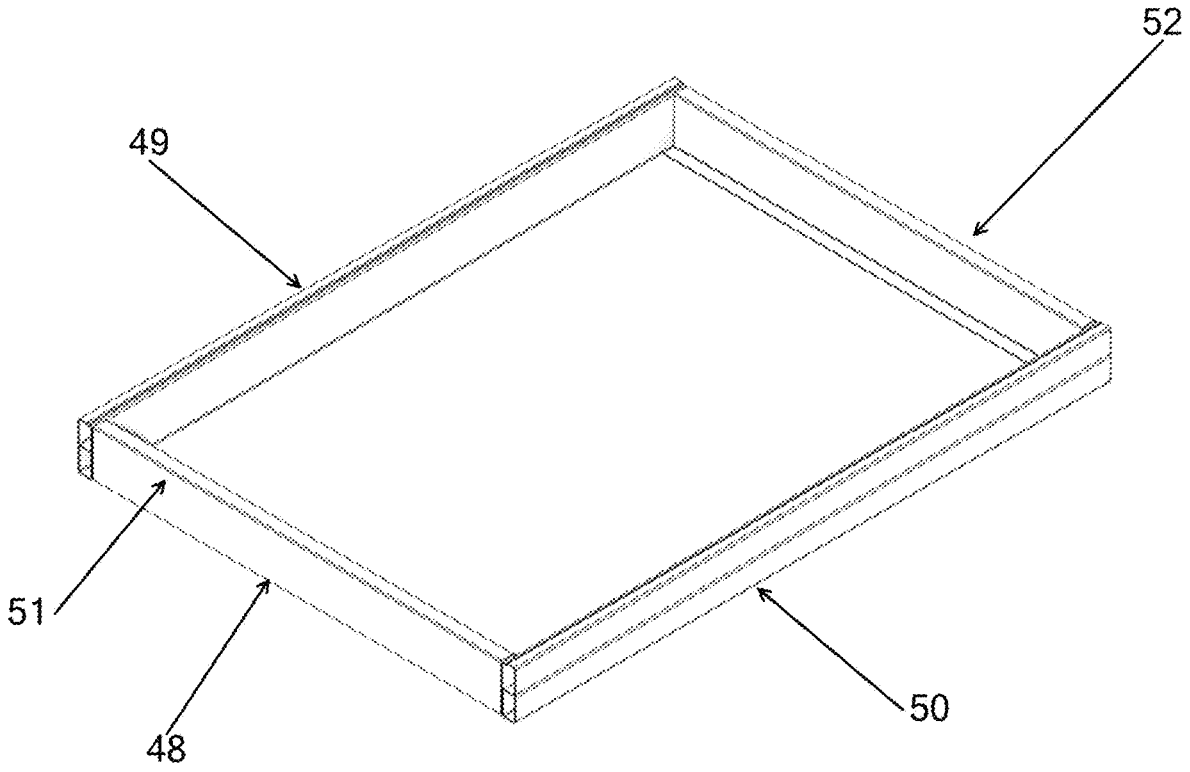

FIG. 29 is a schematic diagram of the product. As shown in FIG. 31, four corners of an integrally rollforming profile are cut. As shown in FIG. 32, front and rear parts of a bottom plate are bent downwards at an angle of 90° by a small edge through a bending technology. As shown in FIG. 33, front and rear parts of a bottom plate are bent upwards at an angle of 90° by a vertical edge through a bending technology. As shown in FIG. 34, front and rear parts of a bottom plate are bent upwards at an angle of 90° by a horizontal edge through a bending technology. As shown in FIG. 35, front and rear parts of a bottom plate are bent upwards at an angle of 90° by a vertical edge through a bending technology. In this way, a frame is formed finally.

The periphery of the frame is welded using a welding technology to form a whole, thereby ensuring the structural integrity, stability and performance requirements of the entire frame.

In the technological process, the offline butt-welding step is canceled, which reduces equipment investment and labor input, significantly reduces equipment investment, factory investment, and machining costs, and creates huge economic benefits.

According to the present invention, an advanced roll forming technology is used for online integral forming, during which there are good product quality and high production stability and efficiency.

In the description of this application, it is to be understood that the orientations or positional relationships indicated by the terms "upper", "lower", "front", "rear", "left", "right", "vertical", "horizontal", "top", "bottom", "inside", "outside", etc. are based on the orientations or positional relationships shown in the accompanying drawings, only for the convenience of describing the present application and simplifying the description rather than indicating or implying that the apparatus or element referred to must have a particular orientation or be constructed and operated in a particular orientation, and therefore cannot be construed as limitations to the present application.

Compared with the prior art, the present invention has the following beneficial effects:

1. According to the manufacturing method in the present invention, the high-strength steel is selected, and the advanced roll forming technology is used for online integral forming, during which there are good product quality and high production stability and efficiency.
2. According to the manufacturing method in the present invention, there are no subsequent steel plate butt-welding and laser hole-cutting steps, thereby reducing personnel and equipment investment, avoiding increasing energy consumption during production, and lowering costs.
3. According to the manufacturing method in the present invention, five types of materials are reduced to one type of material, thereby reducing material types and procurement cycles and costs.
4. In terms of the profile structure prepared in the present invention, the longitudinal beams around the frame are rollformed once, the front and rear beams are bent, then the frame is butt-welded, and the bottom plate and the frame are integrally formed, which reduces welding steps and welding amount, and improves the forming accuracy. The integrity of the frame ensures the overall strength and stiffness of the structure, and improves the anti-collision performance of the structure.

The specific embodiments of the present invention are described above. It is to be understood that the present invention is not limited to the specific embodiments described above, and various changes or modifications may be made by those skilled in the art within the scope of the claims without affecting the spirit of the present invention. The embodiments in this application and the features in the embodiments may be arbitrarily combined with each other under no conflict.

What is claimed is:

1. A method for manufacturing a rollforming frame, comprising the following steps:

step 1: separately rolling and bending a first end and a second end of a plate to separately form a first vertical wall and a first horizontal wall, at the first and the second end respectively, connected to the first vertical wall at each end of the plate, wherein a bottom plate is formed between the first vertical walls at the first end and the second end;

step 2: at both ends of the plate, rolling and bending an end of the first horizontal wall adjacent to the first vertical wall to form a stepped bent structure;

step 3: at both ends of the plate, rolling and bending the first horizontal wall to form a second vertical wall, a second horizontal wall, and a third horizontal wall, wherein the second vertical wall, the second horizontal wall, and the third horizontal wall are connected;

step 4: at both ends of the plate, rolling and bending the second horizontal wall to form a third vertical wall and a fourth horizontal wall connected to each other; and rolling and bending the third horizontal wall to form a fourth vertical wall and a fifth horizontal wall connected to each other, wherein the fourth vertical wall abuts against the first vertical wall;

step 5: at both ends of the plate, performing laser welding on a joint of the fourth vertical wall and the first vertical wall, wherein a first cavity is formed at the first end of the plate, and a second cavity is formed at the second end of the plate;

step 6: at both ends of the plate, rolling and bending an end of the fifth horizontal wall away from the fourth vertical wall to form a connecting edge and a sixth horizontal wall connected to each other;

step 7: at both ends of the plate, rolling and bending the sixth horizontal wall to form a fifth vertical wall and a seventh horizontal wall connected to each other, wherein the connecting edge abuts against the second vertical wall; and step 8: at both ends of the plate, performing the laser welding on a joint of the connecting edge and the second vertical wall, wherein a third cavity is formed at a first end of the plate, and a fourth cavity is formed at a second end of the plate, wherein in the step 1, a first bend structure is formed between the first vertical wall and the bottom plate, and a second bend structure is formed between the first horizontal wall and the first vertical wall;

in the step 2, a third bend structure and a fourth bend structure are formed in the stepped bent structure at both ends;

in the step 3, each of two ends of the second horizontal wall are connected to the stepped bent structure and the second vertical wall respectively, a fifth bend structure is formed between the second horizontal wall and the second vertical wall, and a sixth bend structure is formed between the second vertical wall and the third horizontal wall;

in the step 4, a seventh bend structure is formed between the third vertical wall and the fourth horizontal wall, and each of two ends of the fourth horizontal wall are connected to the stepped bent structure and the third vertical wall respectively;

at both ends of the plate, an eighth bend structure is formed between the fourth vertical wall and the fifth horizontal wall, and each of two ends of the fourth vertical wall are connected to the fifth horizontal wall and the second vertical wall respectively;

in the step 6, a ninth bend structure is formed between the connecting edge and the sixth horizontal wall; and in the step 7, a tenth bend structure is formed between the fifth vertical wall and the seventh horizontal wall, and each of two ends of the fifth vertical wall are connected to the connecting edge and the seventh horizontal wall respectively, and wherein the step 1 comprises the following steps:

step 1.1: separately rolling and bending both ends of the plate to form a first side edge structure and a second side edge structure at the two opposite ends of the plate respectively, wherein the bottom plate is formed between the first side edge structure and the second side edge structure, a first corner structure is formed between the first side edge structure and the bottom plate, and the second corner structure is formed between the second side edge structure and the bottom plate;

step 1.2: at both ends of the plate, separately rolling and bending the first side edge structure and the second side edge structure to form the first vertical wall and the first horizontal wall; and step 1.3: at both ends of the plate, rolling and bending the first vertical wall and the first horizontal wall for multiple times, reducing an angle of the first corner structure to form the first bend structure, and reducing an angle of the second corner structure to form the second bend structure.

2. The method according to claim 1, wherein in the step 1.1, the angle of the first corner structure is 177°;

in the step 1.2, the angle of the first corner structure is 170° and the angle of the second corner structure is 172°; and the step 1.3 comprises the following steps:

step 1.3.1: at both ends of the plate, rolling and bending the first vertical wall and the first horizontal wall, such that the angle of the first corner structure is 160° and the angle of the second corner structure is 162°;

step 1.3.2: at both ends of the plate, rolling and bending the first vertical wall and the first horizontal wall, such that the angle of the first corner structure is 145° and the angle of the second corner structure is 148°;

step 1.3.3: at both ends of the plate, rolling and bending the first vertical wall and the first horizontal wall, such that the angle of the first corner structure is 130° and the angle of the second corner structure is 132°;

step 1.3.4: at both ends of the plate, rolling and bending the first vertical wall and the first horizontal wall, such that the angle of the first corner structure is 115° and the angle of the second corner structure is 118°;

step 1.3.5: at both ends of the plate, rolling and bending the first vertical wall and the first horizontal wall, such that the angle of the first corner structure is 100°, and the angle of the second corner structure is 103°;

step 1.3.6: at both ends of the plate, rolling and bending the first vertical wall and the first horizontal wall, such that the angle of the first corner structure is 90°, the first bend structure is formed, and the angle of the second corner structure is 93°; and step 1.3.7: at both ends of the plate, rolling and bending the first horizontal wall, such that the angle of the second corner structure is 90°, and the second bend structure is formed.

3. The method according to claim 1, wherein the step 2 comprises the following steps:

step 2.1: at both ends of the plate, rolling and bending the end of the first horizontal wall adjacent to the first vertical wall to form a stepped planar structure and a third side edge structure, wherein a third corner structure is formed between the stepped planar structure and the third side edge structure;

step 2.2: at both ends of the plate, rolling and bending the third side edge structure to form a stepped inclined surface structure and a fourth side edge structure, wherein the third corner structure is formed between the stepped planar structure and the stepped inclined surface structure, and a fourth corner structure is formed between the stepped inclined surface structure and the fourth side edge structure; and step 2.3: at both ends of the plate, rolling and bending the fourth side edge structure and the stepped inclined surface structure for multiple times, increasing an angle of the third corner structure to form the third bend structure, and increasing an angle of the fourth corner structure to form the fourth bend structure.

4. The method according to claim 3, wherein in the step 2.1, the angle of the third corner structure is 3°;

in the step 2.2, the angle of the third corner structure is 15° and the angle of the fourth corner structure is 13°; and the step 2.3 comprises the following steps:

step 2.3.1: at both ends of the plate, rolling and bending the fourth side edge structure and the stepped inclined surface structure, such that the angle of the third corner structure is 30° and the angle of the fourth corner structure is 28°;

step 2.3.2: at both ends of the plate, rolling and bending the fourth side edge structure and the stepped inclined surface structure, such that the angle of the third corner structure is 45° and the angle of the fourth corner structure is 42°;

step 2.3.3: at both ends of the plate, rolling and bending the fourth side edge structure and the stepped inclined surface structure, such that the angle of the third corner structure is 54°, the third bend structure is formed, and the angle of the fourth corner structure is 52°; and step 2.3.4: at both ends of the plate, rolling and bending the fourth side edge structure, such that the angle of the fourth corner structure is 54° and the fourth bend structure is formed.

5. The method according to claim 1, wherein the step 3 comprises the following steps:

step 3.1: at both ends of the plate, rolling and bending the first horizontal wall to form the second horizontal wall and a fifth side edge structure, wherein a fifth corner structure is formed between the second horizontal wall and the fifth side edge structure;

step 3.2: at both ends of the plate, rolling and bending the fifth side edge structure to form the second vertical wall and the third horizontal wall, wherein the fifth corner structure is formed between the second horizontal wall and the second vertical wall, and a sixth corner structure is formed between the second vertical wall and the third horizontal wall; and step 3.3: at both ends of the plate, rolling and bending the second vertical wall and the third horizontal wall for multiple times, reducing an angle of the fifth corner structure to form the fifth bend structure, and reducing an angle of the sixth corner structure to form the sixth bend structure.

6. The method according to claim 5, wherein in the step 3.1, the angle of the fifth corner structure is 176°;

in the step 3.2, the angle of the fifth corner structure is 165° and the angle of the sixth corner structure is 170°; and the step 3.3 comprises the following steps:

step 3.3.1: at both ends of the plate, rolling and bending the second vertical wall and the third horizontal wall, such that the angle of the fifth corner structure is 150°, and the angle of the sixth corner structure is 155°;

step 3.3.2: at both ends of the plate, rolling and bending the second vertical wall and the third horizontal wall, such that the angle of the fifth corner structure is 135°, and the angle of the sixth corner structure is 140°;

step 3.3.3: at both ends of the plate, rolling and bending the second vertical wall and the third horizontal wall, such that the angle of the fifth corner structure is 120°, and the angle of the sixth corner structure is 125°;

step 3.3.4: at both ends of the plate, rolling and bending the second vertical wall and the third horizontal wall, such that the angle of the fifth corner structure is 105°, and the angle of the sixth corner structure is 110°;

step 3.3.5: at both ends of the plate, rolling and bending the second vertical wall and the third horizontal wall, such that the angle of the fifth corner structure is 90°, the fifth bend structure is formed, and the angle of the sixth corner structure is 95°; and step 3.3.6: at both ends of the plate, rolling and bending the third horizontal wall, such that the angle of the sixth corner structure is 90°, and the sixth bend structure is formed.

7. The method according to claim 1, wherein the step 4 comprises the following steps:

step 4.1: at both ends of the plate, rolling and bending the second horizontal wall to form the third vertical wall and the fourth horizontal wall, wherein a seventh corner structure is formed between the third vertical wall and the fourth horizontal wall;

step 4.2: at both ends of the plate, rolling and bending the third vertical wall, and reducing an angle of the seventh corner structure for a first time;

step 4.3: at both ends of the plate, rolling the third horizontal wall to form the fourth vertical wall and the fifth horizontal wall, wherein an eighth corner structure is formed between the fourth vertical wall and the fifth horizontal wall; and rolling and bending the third vertical wall, and reducing the angle of the seventh corner structure for a second time; and step 4.4: at both ends of the plate, rolling and bending the fifth horizontal wall and the third vertical wall for multiple times, reducing the angle of the seventh corner structure to form the seventh bend structure, and reducing an angle of the eighth corner structure to form the eighth bend structure.

8. The method according to claim 7, wherein in the step 4.1, the angle of the seventh corner structure when formed is 175°;

in the step 4.2, the angle of the seventh corner structure is 170°;

in the step 4.3, the angle of the seventh corner structure is 160° and the angle of the eighth corner structure is 170°; and the step 4.4 comprises the following steps:

step 4.4.1: at both ends of the plate, rolling and bending the fifth horizontal wall and the third vertical wall, such that the angle of the seventh corner structure is 150°, and the angle of the eighth corner structure is 160°;

step 4.4.2: at both ends of the plate, rolling and bending the fifth horizontal wall and the third vertical wall, such that the angle of the seventh corner structure is 140°, and the angle of the eighth corner structure is 150°;

step 4.4.3: at both ends of the plate, rolling and bending the fifth horizontal wall and the third vertical wall, such that the angle of the seventh corner structure is 130°, and the angle of the eighth corner structure is 140°;

step 4.4.4: at both ends of the plate, rolling and bending the fifth horizontal wall and the third vertical wall, such that the angle of the seventh corner structure is 120°, and the angle of the eighth corner structure is 130°;

step 4.4.5: at both ends of the plate, rolling and bending the fifth horizontal wall and the third vertical wall, such that the angle of the seventh corner structure is 110°, and the angle of the eighth corner structure is 120°;

step 4.4.6: at both ends of the plate, rolling and bending the fifth horizontal wall and the third vertical wall, such that the angle of the seventh corner structure is 100°, and the angle of the eighth corner structure is 110°;

step 4.4.7: at both ends of the plate, rolling and bending the fifth horizontal wall and the third vertical wall, such that the angle of the seventh corner structure is 90°, the seventh bend structure is formed, and the angle of the eighth corner structure is 100°; and step 4.4.8: at both ends of the plate, rolling and bending the fifth horizontal wall, such that the angle of the eighth corner structure is 90°, and the eighth bend structure is formed.

9. The method according to claim 1, wherein the step 6 comprises the following steps:

step 6.1: at both ends of the plate, rolling and bending the end of the fifth horizontal wall away from the fourth vertical wall to form the connecting edge and the sixth horizontal wall, wherein a ninth corner structure is formed between the connecting edge and the sixth horizontal wall; and step 6.2: at both ends of the plate, rolling and bending the connecting edge for multiple times, and reducing an angle of the ninth corner structure to form the ninth bend structure.

10. The method according to claim 9, wherein in the step 6.1, the angle of the ninth corner structure is 180°; and the step 6.2 comprises the following steps:

step 6.2.1: at both ends of the plate, rolling and bending the connecting edge, such that the angle of the ninth corner structure is 150°;

step 6.2.2: at both ends of the plate, rolling and bending the connecting edge, such that the angle of the ninth corner structure is 120°; and step 6.2.3: at both ends of the plate, rolling and bending the connecting edge, such that the angle of the ninth corner structure is 90°, and the ninth bend structure is formed.

11. The method according to claim 1, wherein the step 7 comprises the following steps:

step 7.1: at both ends of the plate, rolling and bending the sixth horizontal wall to form the fifth vertical wall and the seventh horizontal wall, wherein a tenth corner structure is formed between the fifth vertical wall and the seventh horizontal wall; and step 7.2: at both ends of the plate, rolling and bending the fifth vertical wall for multiple times, and reducing an angle of the tenth corner structure to form the tenth bend structure.

12. The method according to claim 11, wherein in the step 7.1, the angle of the tenth corner structure is 163°; and the step 7.2 comprises the following steps:

step 7.2.1: at both ends of the plate, rolling and bending the fifth vertical wall, such that the angle of the tenth corner structure is 145°;

step 7.2.2: at both ends of the plate, rolling and bending the fifth vertical wall, such that the angle of the tenth corner structure is 130°;

step 7.2.3: at both ends of the plate, rolling and bending the fifth vertical wall, such that the angle of the tenth corner structure is 115°;

step 7.2.4: at both ends of the plate, rolling and bending the fifth vertical wall, such that the angle of the tenth corner structure is 100°; and step 7.2.5: at both ends of the plate, rolling and bending the fifth vertical wall, such that the angle of the tenth corner structure is 90°, and the tenth bend structure is formed.

13. The method according to claim 1, wherein in the step 8, a left longitudinal beam portion and a right longitudinal beam portion are formed at first two opposite ends of the bottom plate; and the method for manufacturing the rollforming frame further comprises the following steps:

step 9: cutting the left longitudinal beam portion and the right longitudinal beam portion located at four corners of the bottom plate to form a front longitudinal beam plate and a rear longitudinal beam plate at second two opposite ends of the bottom plate;

step 10: separately bending the front longitudinal beam plate and the rear longitudinal beam plate to form a sixth vertical wall and an eighth horizontal wall, wherein an eleventh bend structure is formed between the sixth vertical wall and the eighth horizontal wall;

step 11: bending the eighth horizontal wall to form a seventh vertical wall and a ninth horizontal wall, wherein a twelfth bend structure is formed between the seventh vertical wall and the ninth horizontal wall;

step 12: bending the seventh vertical wall to form an eighth vertical wall and a tenth horizontal wall, wherein a thirteenth bend structure is formed between the eighth vertical wall and the tenth horizontal wall;

step 13: bending the ninth horizontal wall, such that the sixth vertical wall abuts against the bottom plate, a fourteenth bend structure is formed between the ninth horizontal wall and the bottom plate, and a front longitudinal beam portion and a rear longitudinal beam portion are formed at the second two opposite ends of the bottom plate; and step 14: welding a joint of the front longitudinal beam portion and the left longitudinal beam portion, welding a joint of the front longitudinal beam portion and the right longitudinal beam portion, welding a joint of the rear longitudinal beam portion and the left longitudinal beam portion, welding a joint of the rear longitudinal beam portion and the right longitudinal beam portion, and welding a joint of the sixth vertical wall and the bottom plate.

* * * * *